US009392381B1

(12) United States Patent
Park et al.

(10) Patent No.: US 9,392,381 B1
(45) Date of Patent: Jul. 12, 2016

(54) HEARING AID ATTACHED TO MOBILE ELECTRONIC DEVICE

(71) Applicant: POSTECH ACADEMY-INDUSTRY FOUNDATION, Pohang-si, Gyeongsangbuk-do (KR)

(72) Inventors: Hong June Park, Pohang-si (KR); Seong Eun Cho, Seoul (KR); Dong Hee Yeo, Pohang-si (KR); Young Jae Jang, Sejong-si (KR); Hyeon Kyu Noh, Incheon-si (KR); Sang Hu Park, Pohang-si (KR)

(73) Assignee: POSTECH ACADEMY-INDUSTRY FOUNDATION, Pohang-Si, Gyeongsangbuk-Do (KR)

( * ) Notice: Subject to any disclaimer, the term of this patent is extended or adjusted under 35 U.S.C. 154(b) by 0 days.

(21) Appl. No.: 14/795,266

(22) Filed: Jul. 9, 2015

(30) Foreign Application Priority Data

Feb. 16, 2015 (KR) ..... 10-2015-0023394

(51) Int. Cl.
*H04R 25/00* (2006.01)
*H04R 1/10* (2006.01)

(52) U.S. Cl.
CPC ..... *H04R 25/554* (2013.01); *H04R 1/1083* (2013.01); *H04R 2430/20* (2013.01)

(58) Field of Classification Search
CPC ..... H04R 25/40; H04R 25/558; H04R 1/32; H04R 2430/20; H04R 2430/21; H04R 2430/23; H04R 2430/25; G10L 21/00
USPC ..... 381/74, 92, 23.1, 73.1, 72, 313–315, 381/317, 318, 334, 306, 361, 364, 365, 367, 381/388
See application file for complete search history.

(56) References Cited

U.S. PATENT DOCUMENTS 6,021,207 A * 2/2000 Puthuff ..... H04B 1/385 379/52
7,092,882 B2 * 8/2006 Arrowood ..... G10L 21/0208 704/226
2008/0049957 A1 * 2/2008 Topholm ..... H04R 25/558 381/315
2013/0034241 A1 * 2/2013 Pandey ..... H04M 9/082 381/92

FOREIGN PATENT DOCUMENTS

KR 10-2005-0057781 6/2005
KR 10-2013-0054898 5/2013
KR 10-2014-0084744 7/2014

* cited by examiner

*Primary Examiner* — Sunita Joshi
(74) *Attorney, Agent, or Firm* — Kile Park Reed & Houtteman PLLC

(57) ABSTRACT

Disclosed is a hearing aid attached to a mobile electronic device. Elements forming the hearing aid are separated into a main hearing aid device and a sub-hearing aid device. The main hearing aid device is attached to the casing of a mobile electronic device and connected to the mobile electronic device through a wired cable, and the sub-hearing aid device is placed in an ear of a user. Other people rarely notice that a user uses the hearing aid because the main hearing aid device is mounted on the casing of a mobile electronic device. The hearing aid is supplied with power from the battery of the mobile electronic device, and has the same size as the casing of the mobile electronic device. Accordingly, a beamforming operation through a microphone array is possible, and use convenience and a level of satisfaction of the hearing aid can be improved.

25 Claims, 18 Drawing Sheets micro USB port
(Android smart phone)

1 : VCC

2 : Data-

3 : Data+

4 : ID

5 : GND

Lightning port
(Apple iPhone)

| | |
|---|---|
| 1 : GND | 5 : PWR |
| 2 : Data0+ | 6 : Data1- |
| 3 : Data0- | 7 : Data1+ |
| 4 : ID0 | 8 : ID1 |

HEARING AID ATTACHED TO MOBILE ELECTRONIC DEVICE

BACKGROUND

1. Technical Field

The present disclosure relates to a hearing aid, and more particularly, to a hearing aid attached to a mobile electronic device having improved use convenience, wherein elements forming the hearing aid are separated into a main hearing aid device and a sub-hearing aid device, the main hearing aid device is attached to the casing of a mobile electronic device and connected to the mobile electronic device through a wired cable for data transmission, and the sub-hearing aid device is placed in an ear of a user.

2. Related Art

Recently, as the average span of a man's life increases over 70 years or more, the demand for a hearing aid is gradually increased. The necessity for the hearing aid was recognized in the past, and the hearing aid was developed since the 1600s.

In the past, when a sound is not heard, a person can obtain an amplified sound of about 5 to 10 dB in an intermediate frequency or a high frequency by placing two hands in the auricles. In the 1600s, there was developed a hearing aid configured to have a wide sound collection unit, such as large Fallopian tubes, in order to collect sounds.

Thereafter, in the 1870s, a carbon hearing aid was developed based on the principle of a telephone. In the carbon hearing aid, if input voice pressure is changed over time, the density of carbon grains is changed and thus the resistance value of the carbon grains is changed. A change of the voice pressure over time is converted into a change in the waveform of the electrical signal of a voltage or current over time through a change in the resistance value of the carbon grains. The converted electrical signal is amplified, and the speaker of the hearing aid is driven by the amplified electrical signal. In this case, an acoustic gain of about 20 to 30 dB could be obtained.

In the 1920s, a hearing aid using a vacuum tube was developed. A change of voice pressure received through a microphone (i.e., a transmitter) having a coil connected to a magnet is converted into a change of an electrical signal through a movement of the coil of the microphone. The converted electrical signal is amplified through a vacuum tube amplifier, and the speaker of the hearing aid is driven by the amplified signal. In this case, an acoustic gain of about 70 dB could be obtained. However, the hearing aid using the vacuum tube is disadvantageous in that the size of a battery is large and heavy and difficult to use because it requires a high voltage of 100 V or more in order to drive the vacuum tube circuit.

In the 1950s, a hearing aid using a transistor was developed. A battery size is small because the transistor required a low operating voltage, and thus a circuit size is small. If such a transistor is used, a hearing aid having a small size may be fabricated. In particular, in the 1960s, an integrated circuit (IC) in which several transistors are embedded in a single chip was developed. Thereafter, hearing aids using the integrated circuits, such as a glasses type, a behind-the-ear (BTE) type, and an in-the-ear (ITE), were sequentially developed.

Thereafter, the size of the hearing aid was further reduced. In the 1980s, an external auditory meatus (in-the-canal (ITC)) type hearing aid that is fully put in an ear was developed. In the 1990s, an eardrum (completely-in-canal (CIC)) type hearing aid that is rarely noticed was developed.

The existing BTE type hearing aid is configured so that the entire hearing aid including a speaker is included in one earring module and an audio signal output by the speaker of the hearing aid is transferred to the eardrum of an ear through an air tube attached to the earring module. Thereafter, there was developed a receiver-in-canal (RIC) type hearing aid in which the speaker (i.e., a receiver) is separated from the hearing aid module of the earring type hearing aid, the speaker is placed close to the eardrum of the external auditory meatus within an ear, and the hearing aid module and the speaker are connected by two metal conducting wires.

Accordingly, the size of the hearing aid module can be increased compared to the ITE, ITC, or CIC type hearing aid by placing the hearing aid module behind an ear and placing the speaker (i.e., a receiver) within the ear. As a result, a control button for volume control and a battery having a relatively high capacity could be mounted on the hearing aid module, and the size of the hearing aid module was further reduced compared to the existing BTE type hearing aid. Accordingly, there are advantages in that a feeling of wearing is good and the hearing aid is rarely noticed by other people.

In recent years, with the significant development of the integrated circuit technology, a digital hearing aid in which all the circuits for a hearing aid function are basically implemented within one dedicated application specific integrated circuit (ASIC) chip is chiefly used. In the digital hearing aid, an electrical signal output by a microphone is made to pass through a pre-processing amplifier, a variable gain amplifier (VGA), and a low pass filter (LPF) and is converted into digital code through an analog-to-digital converter (ADC). Digital code suitable for the hearing characteristics of a person is output by applying various digital signal processing processes for the hearing aid function to the converted digital code. The output digital code is transferred to an ear of the person by driving the speaker through a digital-to-analog converter (DAC) or a class-D amplifier.

A signal processing algorithm used in such a digital hearing aid includes a directional microphone function for audio signals, a wide dynamic range compression (WDRC) function, an acoustic feedback cancellation function, a graphic frequency equalizer function, a noise reduction function, and a tinnitus (ringing) cancellation function.

From among the functions, the WDRC function refers to a function for separating a single microphone input signal into some frequency band signals, determining different threshold amplitude for each of the frequency band signals, amplifying the input signal with a linear-gain amplifier if input amplitude is smaller than the threshold amplitude and performing a log-linear compression if input amplitude is larger than the threshold amplitude at each of the frequency signal band, having different values of the linear-amplifier gain and the log-linear compression ratio for each of the frequency band signal, and adding the output signals of all the frequency band signals. Accordingly, the user of the hearing aid can well hear a signal of a wide amplitude range by greatly amplifying a signal having small amplitude and slightly amplifying a signal having great amplitude although a signal amplitude range in which the user may hear a signal when the user does not use the hearing aid is small. In the WDRC function, if threshold amplitude in all the frequency bands is set infinite and only an amplifier gain in each frequency band is different depending on the frequency band, the graphic frequency equalizer function can be performed.

The acoustic feedback is a phenomenon generated because both the microphone and the speaker are embedded in the hearing aid having a small size and thus the distance between the speaker and the microphone is close (usually within 2 cm). Thereafter, the audio signal output from the speaker is inputted to the microphone again, thereby being capable of generating a braying sound or echo, such as "whistling." This is called the acoustic feedback. In particular, in order to prevent a phenomenon in which the user feels uncomfortable due to a difference between pressure in the external auditory meatus of the ear and atmospheric pressure transferred to the ear through the neck and nose if the hearing aid fully clogs the external auditory meatus, a ventilation hole that penetrates the hearing aid is always present in the hearing aid, such as the ITE, ITC, or CIC type. The acoustic feedback phenomenon is generated through the ventilation hole.

The hearing aid needs to be unnoticeable by other people because the user of the hearing aid does not want other people to know that the user uses the hearing aid. Accordingly, most of current hearing aid products are being developed in the form of the CIC type hearing aid that is greatly reduced in size and fully fit into an ear or the RIC type hearing aid in which the hearing aid and the speaker are separated and the hearing aid is rarely noticed due to a small size although the hearing aid is placed outside the ear In general, the number of microphones mounted on one of the hearing aids is limited to 2 or 3 and the size of an embedded circuit and battery is also limited because the hearing aid is fully fit into the ear and the size of the hearing aid needs to be small enough so that other people rarely notices the hearing aid. It is advantageous that the number of chips forming a circuit for a hearing aid operation is a minimum because the circuit needs to be embedded in the hearing aid having a small size as described above. Accordingly, most of hearing aid manufacturers tend to implement all the circuits for the hearing aid within a single integrated circuit chip.

If surrounding noises are great, it is difficult for the user of the hearing aid to hear a required audio signal due to a masking phenomenon in cochleae. If a microphone array in which several microphones are regularly disposed in a one-dimensional or two-dimensional manner and a beamformer are used, surrounding noises can be removed with respect to at least a high frequency signal, and thus only an audio signal from a required direction can be heard. In an existing acoustic camera, a distribution of the intensities of audio signals can be displayed on a video signal relatively in detail using the microphone array and the beamformer. To this end, a microphone array including several tens of microphones is required. In existing hearing aids, the microphone array and the beamformer cannot be used because a maximum number of the microphones are commonly limited to 2 or 3 due to a limit to the size of the hearing aid.

Recently, as almost everyone carries at least one smart phone having a computer function added to a handheld phone, a technology in which the smart phone itself is used as a hearing aid was proposed KR Publication No 2014-0084744. That is, the hearing aid operation can be implemented by adding only application software without adding a separate hardware device to an existing smart phone in such a manner that a voice is obtained through the microphone of a smart phone, an application processor (AP) corresponding to the central processing unit (CPU) of the smart phone is used as a digital signal processor (DSP), and the voice output signal of the smart phone is transferred to an earphone through an earphone cable or Bluetooth wireless transmission.

However, a relatively long time is taken to drive application software for the hearing aid operation using only the AP of an existing smart phone because hearing aid signal processing-dedicated hardware is not embedded in the existing smart phone unlike in a hearing aid-dedicated DSP.

In general, it is known that a delay time taken for an audio signal to be delivered to an ear through a hearing aid device is less than 10 msec (0.01 second) in order for the audio signal to be not inconsonant to the ear. In this case, a single audio signal is separated into two audio signals of a sound component that is directly delivered to the ear without passing through the hearing aid device and a sound component that is delivered to the ear slightly late through the hearing aid device, and the separated audio signals are delivered to the ear. If a difference between the time taken for one of the two audio signals to be delivered to the ear and the time taken for the other of the two audio signals to be delivered to the ear is greater than 0.01 seconds, a corresponding person recognizes that the same audio signal is repeated twice because he or she recognizes the two audio signals as two different audio signals.

Furthermore, a person who has a severe hearing defect guesses what a counterpart says by seeing the counterpart's lip operations by his or her eyes. It is known that such a person feels very inconvenient if there is a great difference between the time taken for a sound to be guessed eye through lip operations and the time taken for a sound to be heard by the ear through the hearing aid. Accordingly, if a hearing aid is configured using only an existing smart phone without separate hardware, there is a disadvantage in that it is practically difficult to use the existing smart phone as the hearing aid because a delay time for signal processing is much greater than 0.01 seconds.

In order to solve such a problem, active research is being recently carried out in order to connect a smart phone and an existing hearing aid instead of using the smart phone itself as a hearing aid. Several companies have released hearing aids connected to Apple's iPhone in 2014.

FIG. 1 is a diagram illustrating a conventional hearing aid connected to a smart phone.

In FIG. 1, conventional hearing aids connected to a smart phone have been released under the name of "Made for iPhone Hearing Aids (MFi hearing aids)." In such hearing aids, a Bluetooth radio signal receiver has been added to existing hearing aids. In this case, an external audio signal can be received through the microphone of the existing hearing aid or a signal output by iPhone can be received through a Bluetooth receiver.

If a signal output by iPhone is received using the MFI hearing aid 120, a counterpart's voice can be heard more loudly and clearly by placing the iPhone 110 close to the counterpart, and a voice over the iPhone from the counterpart can also be heard more clearly because the voice is corrected according to the ear characteristics of a corresponding user through the existing hearing aid. Furthermore, there is an advantage in that several parameter values of the hearing aid that need to be controlled according to the ear characteristics of the user can be controlled relatively easily through an application (app) program executed in the iPhone.

However, it is necessary to satisfy a condition in which a delay time between the time taken for the iPhone to receive an audio signal through an iPhone microphone and the time taken for the audio signal to reach the ear of the user through the audio signal processing path of the iPhone and the signal processing path of the existing hearing aid must be smaller than 0.01 seconds. Furthermore, if a Bluetooth wireless device is used, there is a disadvantage in that the time taken to replace a battery is shorter in the MFI hearing aid than in an existing hearing aid because the consumption of the battery of the Bluetooth wireless device is twice or more than that of a near field magnetic induction (NFMI) wireless device.

SUMMARY

Various embodiments are directed to a hearing aid attached to a mobile electronic device having improved use convenience, such as that the use of the hearing aid is not externally exposed, a battery is not required, only an audio signal propagated only in a required direction is selectively amplified, and parameter values according to the user's ear characteristics of the hearing aid can be freely controlled, in such a manner that elements forming the hearing aid are separated into a main hearing aid device and a sub-hearing aid device, the main hearing aid device is attached to the casing of a mobile electronic device, the main hearing aid device is connected to the mobile electronic device through a wired cable for data transmission, and the sub-hearing aid device is placed in an ear of a user.

In an embodiment, a hearing aid attached to a mobile electronic device includes a first hearing aid device configured to convert an external audio signal into an audio signal suitable for the hearing characteristics of a user by processing the external audio signal and output the converted audio signal, and a second hearing aid device configured to comprise a speaker and optionally a driving circuit and placed in an ear of the user. The first hearing aid device is mounted on the casing of the mobile electronic device and connected to the mobile electronic device through a first connection device, and the second hearing aid device is connected to the first hearing aid device through a second connection device.

In this case, the first hearing aid device includes a microphone array configured to have m (m is a natural number of 4 or more) microphones arrayed in the microphone array in a one-dimensional, two-dimensional, or three-dimensional manner and a beamformer unit configured to receive a plurality of output signals of the microphone array, delay the output signals by respective predetermined times, add up the delayed signals, and output a beamformer unit output signal that is a digital signal.

The first hearing aid device includes a MUX configured to select one of the beamformer unit output signal and a sound output data signal and output the selected signal, a digital signal processor configured to receive the output signal of the MUX, perform signal processing on the received signal, and output the processed signal, a modulation signal generation unit configured to receive the output signal of the digital signal processor and generate a pulse width modulation signal or a pulse density modulation signal, a controller configured to receive an external signal or a control signal from the mobile electronic device and control the operation of the first hearing aid device and the mobile electronic device, a first connection device conversion unit connected to the mobile electronic device through the first connection device, and a second connection device conversion unit connected to the second hearing aid device through the second connection device.

The mobile electronic device may be a smart phone, a tablet PC, or a portable multimedia player (PMP) in which a central processing unit (CPU) and a battery are embedded.

The hearing aid further includes a third hearing aid device configured to have the same structure as the second hearing aid device and connected to the first hearing aid device through the second connection device. The second hearing aid device and the third hearing aid device may be placed in the left and right ears of the user.

The first hearing aid device is supplied with power from the mobile electronic device through a conducting wire for power supply included in the first connection device.

The first connection device uses a digital data transmission method other than the conducting wire for power supply.

Furthermore, the first connection device uses interface methods according to a universal serial bus (USB) standard and a mobile high definition link (MHL) standard, but uses only one of the interface methods according to the two standards on a specific time.

The second connection device may include an earphone cable or a wireless transmission device.

The beamformer unit further includes a storage device configured to comprise information about the delay times of the plurality of output signals of the microphone array. The storage device may be included in a single integrated circuit chip along with the beamformer unit.

The contents of the storage device are downloaded from the mobile electronic device to the storage device only once through the first connection device when the first hearing aid device is first connected to the mobile electronic device or right after the first hearing aid device is reset.

The first hearing aid device operates in a hearing aid mode and a telephone call mode.

When the first hearing aid device operates in the hearing aid mode, the MUX selects the beamformer unit output signal and transfers the selected beamformer unit output signal to the digital signal processor. When the first hearing aid device operates in the telephone call mode, the MUX selects an audio signal output by the mobile electronic device through the first connection device conversion unit and transfers the selected audio signal to the digital signal processor. The controller performs control so that the speaker of the mobile electronic device connected to the first hearing aid device is turned off through the first connection device conversion unit.

Parameter values for an operation of the first hearing aid device may be controlled through an application program operating in the mobile electronic device.

Each of the microphones forming the microphone array outputs a differential analog signal.

The beamformer unit includes one digital beamformer and m (m is a natural number of 4 or more) channels each configured to include a pre-processing amplifier, a variable gain amplifier, a filter, and an analog to digital converter.

In this case, all of the pre-processing amplifiers, the variable gain amplifiers, the filters, and the analog to digital converters are formed into a fully-differential circuit. The output signals of the analog to digital converters are subjected to the respective predetermined delay times and added up in the digital beamformer and are output as the beamformer unit output signal.

The first connection device conversion unit includes a USB transceiver configured to send and receive a USB input signal and a USB output signal, a HDMI receiver configured to alternately output a video signal and an audio signal, an audio data extractor configured to extract only an audio signal from the outputs of the HDMI receiver and output the sound output data signal, and a USB/MHL switch connected to the micro-USB port of the mobile electronic device through the first connection device.

The first connection device may be implemented using a USB cable.

The second connection device conversion unit includes a loop antenna for near field magnetic induction (NFMI) transmission, a voltage to current converter configured to receive the output signal of the first hearing aid device and output a change of a magnetic field by driving the loop antenna for NFMI transmission, a class D amplifier and a low bandpass filter configured to receive the output signal of the modulation signal generation unit of the first hearing aid device, amplify the received signal into an audible audio signal, and output the audible audio signal, and an audio jack configured to output the output signal of the low bandpass filter.

All circuits forming the first hearing aid device may be disposed on a single printed circuit board (PCB).

The central point of the first hearing aid device may be placed within 30 cm from the center of the mobile electronic device.

DETAILED DESCRIPTION

Figure 1:
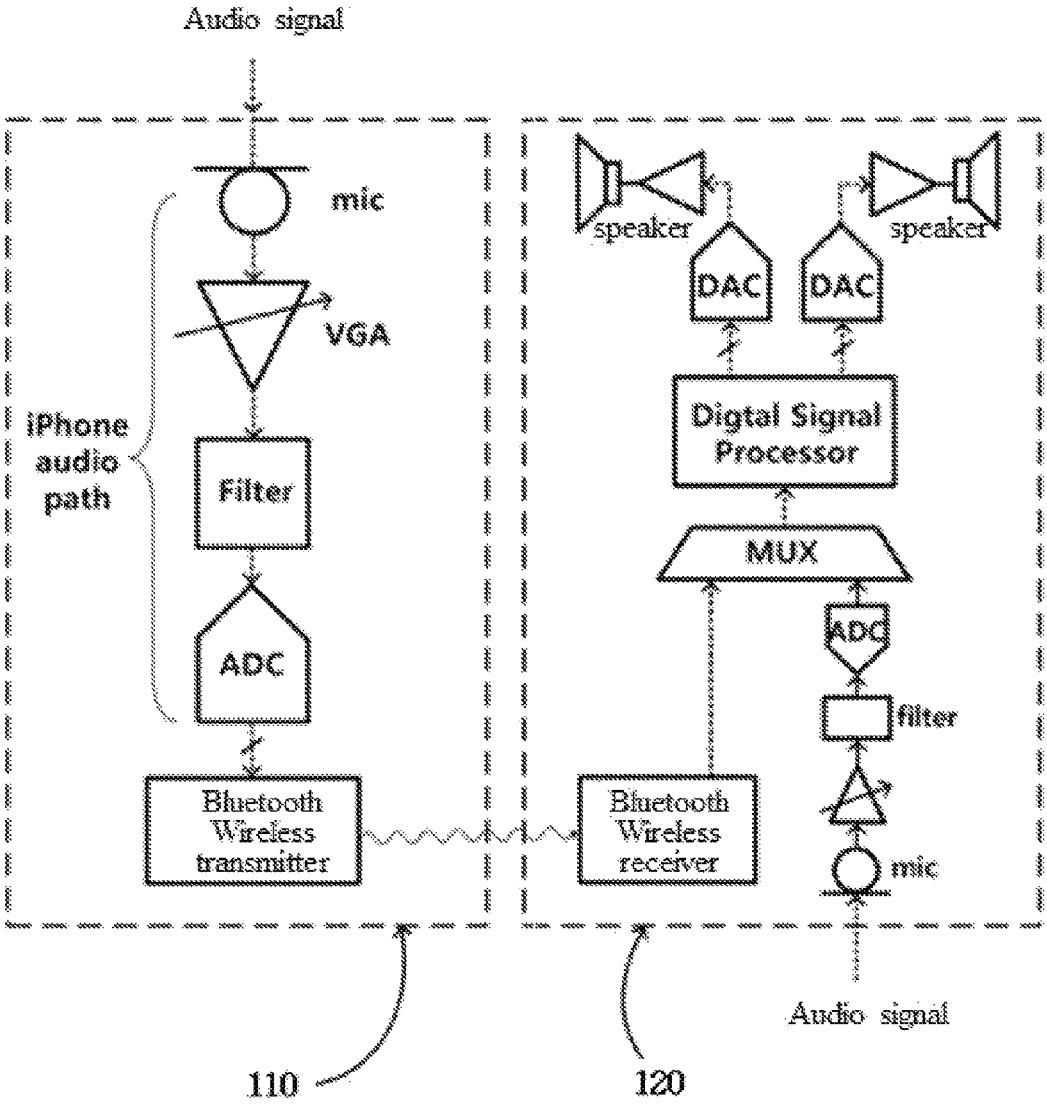
FIG. 1 Prior Art
FIG. 1 is a diagram illustrating a conventional hearing aid connected to a smart phone.

Exemplary embodiments will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments of the disclosure.

An embodiment of the present disclosure has been invented based on the following spirit as means for solving the problems related to the conventional hearing aids.

Today, each person always carries one or more smart phones and uses a smart phone casing in order to protect the smart phone. In this case, a first hearing aid device (i.e., a main hearing aid device) is attached to the smart phone, and the first hearing aid device is connected to a second hearing aid device (i.e., an earphone) using a wired or wireless connection method. In an embodiment of the present disclosure, the first hearing aid device is mounted on the smart phone casing, so other people rarely notice that a user uses a hearing aid and the size of the first hearing aid device can be increased by the size of the smart phone.

If the size of the first hearing aid device is about 140 mm×70 mm, that is, the size of a common smart phone, a beamforming technology used in an existing acoustic camera may be applied to a hearing aid. That is, the influence of surrounding noises on at least a high frequency signal can be reduced and only an audio signal in a required direction can be clearly heard by disposing a one-dimensional, two-dimensional, or three-dimensional microphone array including four or more microphones in the smart phone casing and applying the output signal of the microphone array to a beamformer unit.

If the size of the microphone array is about 140 mm×70 mm, that is, the size of the smart phone, beamforming is not well performed in a frequency of 1 kHz or less, but is well performed in a frequency band of 3 kHz-5 kHz which is well heard by people. Accordingly, only an audio signal of a required direction from which surrounding noises have been removed can be transferred to an ear of a user so that it is clearly heard with respect to a signal included in the frequency band of 3 kHz-5 kHz.

Furthermore, as the size of a hearing aid is reduced, the size of a battery embedded in the hearing aid is also reduced. Today, a zinc-air battery, that is, the size 5 or 10, is commonly used in the eardrum (CIC) type hearing aid, that is, a hearing aid having the smallest size. The capacity of the zinc-air battery in the size 5 is 40 mAh, and the capacity of the zinc-air battery in the size 10 is 100 mAh. Accordingly, if the eardrum type hearing aid is used, it is inconvenient to frequently change the battery.

The capacity of the battery in a current smart phone is about 4000 mAh. In an embodiment of the present disclosure, the first hearing aid device does not require a battery because the first hearing aid device mounted on the smart phone casing is supplied with power from the battery of the smart phone. In the case of an Android phone, power of 5 V is supplied to the outside of a smart phone through a micro USB port attached to the smart phone, and thus power of 5V can be used as power for the first hearing aid device. In the case of Apple's iPhone, power of 5 V is supplied through a lightning port attached to the smart phone, and can be used as power for the first hearing aid device.

The zinc-air battery of the size 5 or size 10 may be used in the second hearing aid device (i.e., the earphone) in accordance with an embodiment of the present disclosure. Hours of battery use is increased in the second hearing aid device because the first hearing aid device is responsible for all types of signal processing and the second hearing aid device has only to amplify an audio signal received through a cable or wireless transmission and drive the earphone. Accordingly, it is not necessary to frequently change the battery.

Furthermore, a counterpart's voice signal is transferred to the first hearing aid device in a digital form because the first hearing aid device and a smart phone are connected using a wired digital interface attached to the smart phone. The first hearing aid device converts the received digital audio signal into an audio signal suitable for the hearing characteristics of a user who uses the hearing aid by passing the received digital audio signal through a digital signal processor, and transfers the converted audio signal to the second hearing aid device. A USB method and an MHL method may be used as the wired digital interface method. Accordingly, a counterpart's voice through the smart phone can be clearly heard using the first hearing aid device.

The parameter values of the first hearing aid device can be changed according to the hearing characteristics of a user because a control signal is transferred from the smart phone of the user who uses a hearing aid to the first hearing aid device through the wired digital interface that connects the first hearing aid device and the smart phone. To this end, there is a need for an application (app) program operating in the application processor (AP) of the smart phone. A USB communication method supported by an existing smart phone may be used in order to send the control signal from the smart phone to the first hearing aid device through the wired digital interface or to send a signal from the first hearing aid device to the smart phone.

The first hearing aid device has two operation modes: a hearing aid mode and a telephone call mode. The hearing aid mode is used when the user of a hearing aid talks with other people within the talking distance from the user. In the hearing aid mode, an audio signal is received through the microphone array included in the first hearing aid device, and a corresponding sound is transferred to an ear of the user through the speaker of the second hearing aid device. The telephone call mode is used when a telephone call is made through a smart phone. In the telephone call mode, an audio signal output by a smart phone is used as a signal inputted to the first hearing aid device, and a corresponding sound is transferred to an ear of the user through the speaker of the second hearing aid device.

In the hearing aid mode, the acoustic feedback phenomenon is not generated because the smart phone casing included in the microphone array is very far from an ear in which the second hearing aid device is placed. In contrast, in the telephone call mode, a sound is not output to the speaker of the smart phone, but is output to only the speaker of the second hearing aid device in the same manner that when an earphone jack is put into a smart phone, an audio signal is not output to the speaker of the smart phone, but is output to only the speaker of the earphone.

When a normal telephone call is made, in the telephone call mode, the acoustic feedback phenomenon is not generated because a user is unable to hear his or her voice, but can hear only a counterpart voice through a receiver. A user may hear his or her voice through a telephone receiver in the form of an echo when making a telephone call. Even in such a case, the acoustic feedback phenomenon is rarely generated because the distance between the microphone of a smart phone to which his or her voice is inputted during the telephone call and the second hearing aid device in which the speaker is placed is commonly 10 cm or longer. Accordingly, the aforementioned acoustic feedback removal function of hearing aid-dedicated hardware is almost not required.

Embodiments of the present disclosure are described in detail below with reference to the accompanying drawings.

Recently, as one of researches on a smart phone application, a mobile high-definition link (MHL) standard in which a video signal displayed on a smart phone and an audio signal output to the speaker of the smart phone are converted into a high definition multimedia interface (HDMI) signal using wired data communication through the data input/output port of the smart phone so that the converted signal can be viewed through TV was established in 2010.

FIG. 2 is a diagram illustrating the data input/output port of a smart phone.

Figure 2A:
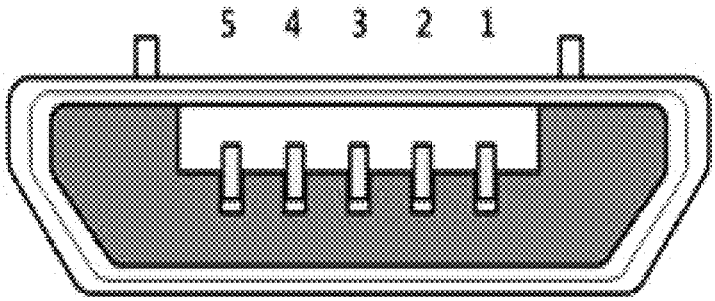
FIGS. 2A and 2B are diagrams illustrating the data input/output port of a smart phone.
Figure 2B:
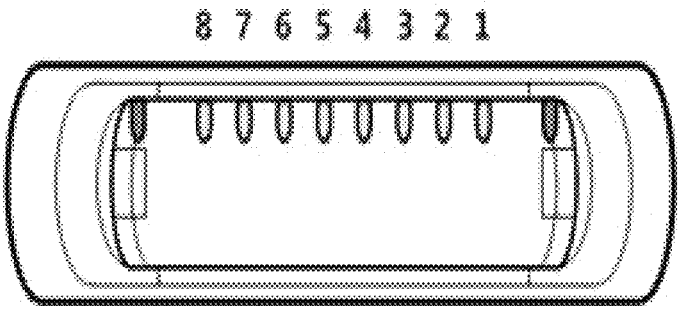

As illustrated in FIG. 2A, a 5-pin micro-universal serial bus (USB) port is chiefly used in a smart phone using an Android operating system (OS) (hereinafter referred to as an Android phone) as the data input/output port of a smart phone. As illustrated in FIG. 2B, an 8-pin lightning port is chiefly used in iPhone using iOS as the data input/output port of a smart phone.

If the MHL function is used, a digital audio signal output by a smart phone through the data input/output port of the smart phone can be obtained in a hearing aid relatively easily. If the USB method is used, control signals and data can be exchanged between the smart phone and the hearing aid relatively easily. A wireless transmission method, such as Bluetooth, is used in almost all of researches for connecting the hearing aid and the smart phone so far. If a wired transmission method through the wired data input/output port of the smart phone is used, there is an advantage in that high-speed data communication can be performed with relatively low power.

In addition, the wired data input/output port of the smart phone includes a 5 V supply voltage pin that is common to a micro-USB port (in an Android phone) and a lightning port (in iPhone). Accordingly, if the smart phone and the first hearing aid device (i.e., a main hearing aid device) are connected using the wired transmission method through the data input/output port of the smart phone, the first hearing aid device can be supplied with required power from a battery of a relatively high capacity included in the smart phone. Accordingly, there is an advantage in that a separate battery does not need to be used in the first hearing aid device.

Figure 3:
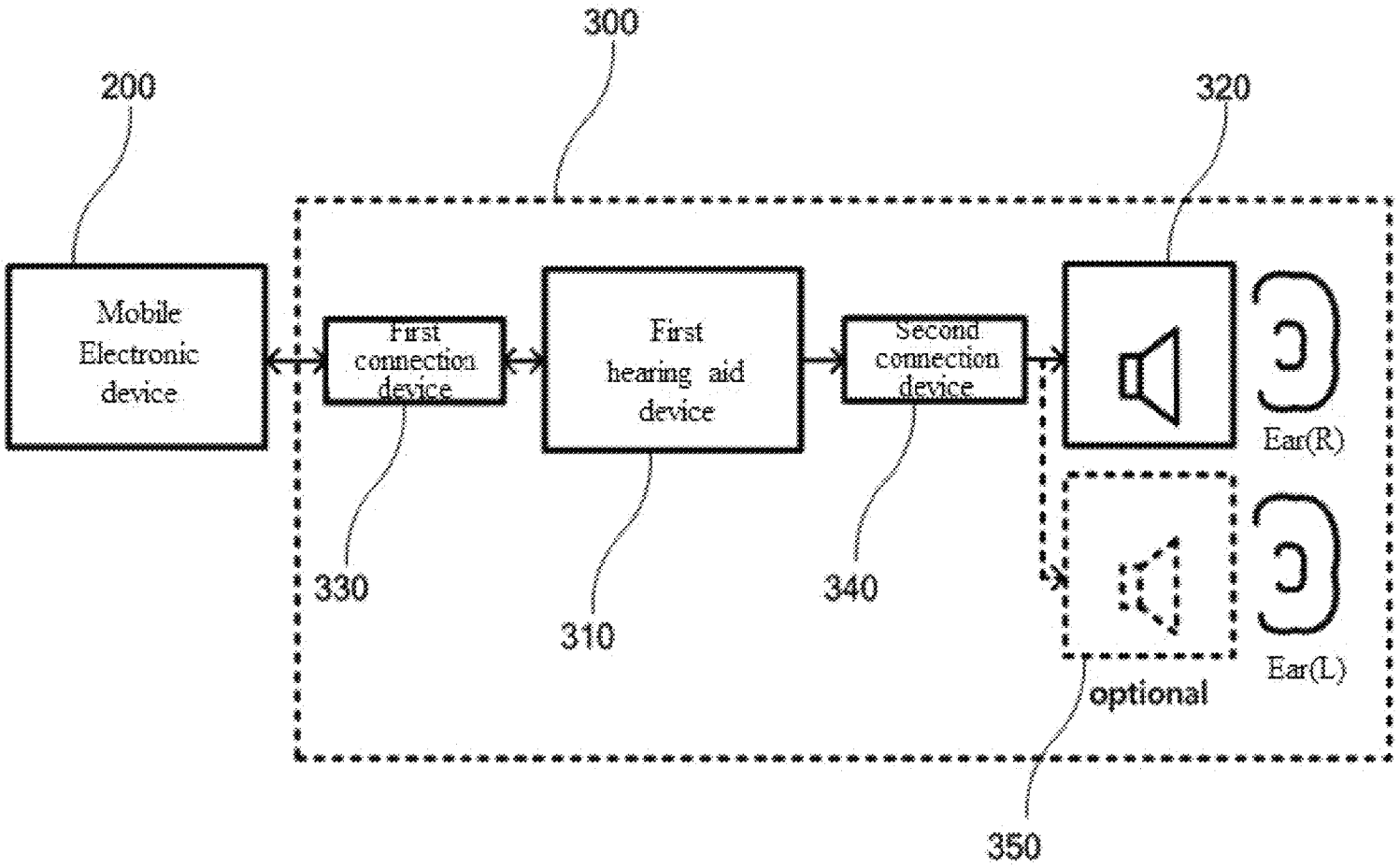
FIG. 3 is a diagram illustrating the configuration of a hearing aid attached to a mobile electronic device in accordance with an embodiment of the present disclosure.

FIG. 3 is a diagram illustrating the configuration of a hearing aid attached to a mobile electronic device in accordance with an embodiment of the present disclosure.

In an embodiment of the present disclosure, a microphone array and a beamformer used in an acoustic camera and a wired transmission method through the data input/output port of a smart phone have been applied to a hearing aid. To this end, a hearing aid 300 is separated into the first hearing aid device 310 and the second hearing aid device 320. The first hearing aid device 310 includes major functions for the hearing aid, such as a microphone array, analog amplifiers, ADCs, a digital signal processor, and a smart phone interface. The second hearing aid device 320 includes only an earphone function for a speaker and may include a speaker driving circuit and a wireless signal receiver.

A microphone array that is impossible to be used in an existing hearing aid may be used in the first hearing aid device 310 because the size of the first hearing aid device 310 is increased by the size of the smart phone 200. Furthermore, a circuit, such as a beamformer that consumes relatively large power, may be used in the first hearing aid device 310 because power is supplied by the battery of the smart phone 200 through the 5V supply voltage pin of the data input/output port of the smart phone.

In an embodiment of the present disclosure, the hearing aid 300 is separated into the first hearing aid device 310 (or the main hearing aid device) and the second hearing aid device 320 (or the sub-hearing aid device, such as an earphone). The first hearing aid device 310 is mounted on a smart phone casing, and the second hearing aid device 320 is placed in an ear of a user. The first hearing aid device 310 and the smart phone 200 are connected using a first connection device 330 of a wired digital interface method. The first hearing aid device 310 and the second hearing aid device 320 are connected using a second connection device 340 of a wired or wireless transmission method.

An audio signal from the first hearing aid device 310 is transmitted to the second hearing aid device 320. The second hearing aid device 320 includes a speaker and may include a wireless signal receiver and a circuit for driving the speaker. A third hearing aid device 350 having the same configuration as the second hearing aid device 320 may be added. In this case, the second hearing aid device 320 and the third hearing aid device 350 may be inserted into a right ear and a left ear, so the hearing aids can be used for both ears.

In general, the user of a smart phone inserts a casing or cover, that is, a protection device, into the smart phone in order to prevent an impact on the smart phone. The protection device of the smart phone is hereinafter called a smart phone casing. In an embodiment of the present disclosure, the first hearing aid device 310 is placed in the smart phone casing.

Figure 4:
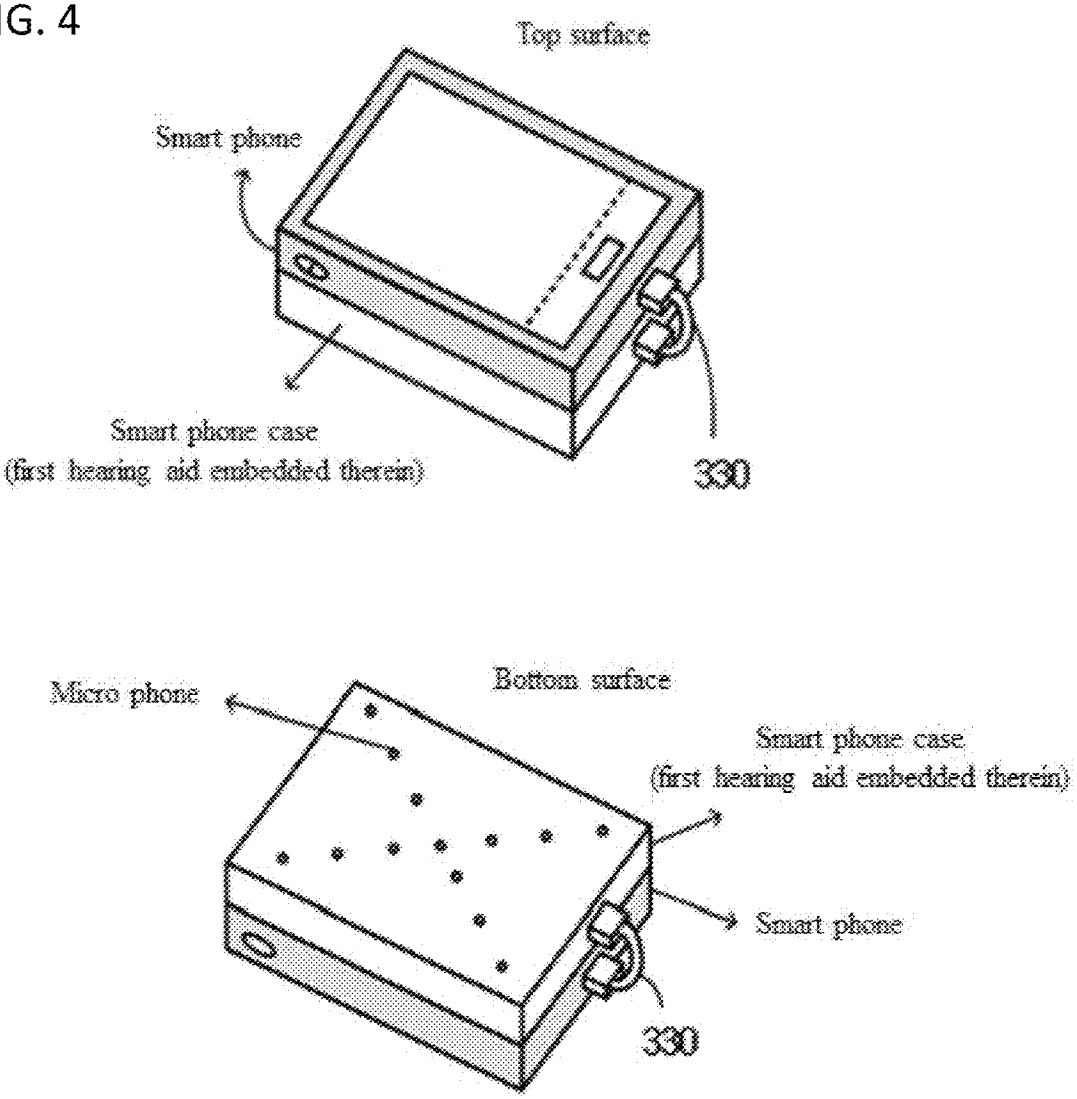
FIG. 4 is a conceptual diagram illustrating that a first hearing aid device is embedded in a smart phone casing in the hearing aid attached to a mobile electronic device in accordance with an embodiment of the present disclosure.

FIG. 4 is a conceptual diagram illustrating that a first hearing aid device is embedded in the casing of the smart phone in the hearing aid attached to a mobile electronic device in accordance with an embodiment of the present disclosure.

From FIG. 4, it may be seen that the first hearing aid device 310 of the hearing aid in accordance with an embodiment of the present disclosure has been mounted on the smart phone casing inserted into one side of the smartphone that is opposite to the side. In FIG. 4, an example in which the first hearing aid device 310 has been embedded in the smart phone casing in the insertion form has been illustrated. In some embodiments, the first hearing aid device 310 may be mounted on the casing of a flip type smart phone or a smart phone accessory.

A printed circuit board (PCB) to which an integrated circuit forming the first hearing aid device 310 has been attached is mounted on the inside of the smart phone casing so that it is not externally viewed. The microphone array connected to the first hearing aid device 310 is mounted on the outside surface of the smart phone casing. The microphones may be disposed in a straight line in the diagonal direction of the smart phone casing in order to increase the array length to a maximum extent. Accordingly, the distance between the center of the first hearing aid device 310 and the center of the smart phone becomes very close, and the distance between the two centers may be limited to 30 cm or shorter.

The first hearing aid device 310 is connected to the smart phone through the first connection device 330 and the data input/output port of the smart phone. As described with reference to FIG. 2, the number of connection pins of the data input/output port of an Android phone which is chiefly used recently is 5, and the number of connection pins of the data input/output port of iPhone which is chiefly used recently is 8. Through the 5V supply voltage pins (VCC in FIG. 2A and PWR in FIG. 2B) of both smart phones, however, power may be supplied from the smart phone to the first hearing aid device 310. Accordingly, a separate battery is not required because the first hearing aid device 310 of the hearing aid in accordance with an embodiment of the present disclosure is supplied with power through the data input/output port of the smart phone.

The capacities of the zinc-air batteries, that is, the size 5 and the size 10 which are chiefly used in the current eardrum (CIC) type hearing aid, are 40 mAh and 100 mAh. In contrast, the capacity of the battery of a smart phone is 4000 mAh or more. Accordingly, if power consumption of the first hearing aid device 310 is much smaller than that of the smart phone, the first hearing aid device 310 in accordance with an embodiment of the present disclosure can be driven without adding a separate battery.

An embodiment of the present disclosure may be applied to both Android phones and iPhone. In this specification, an example in which an embodiment of the present disclosure has been applied to an Android phone is described.

In the micro-USB port of FIG. 2, an ID pin functions to provide notification of whether the smart phone will operate as a host or a device. In general, the USB is used to connect a USB device, such as a memory stick, to a personal computer (PC), that is, a host. The host (i.e., PC) takes the lead in a control operation for a USB interface operation. When the smart phone is connected to the PC through the micro-USB port, the smart phone operates as a device, and the PC operates as a host. When a USB OTG memory stick is connected to the smart phone, the smart phone operates as a host.

Whether a smart phone will operate as a host or a device is determined by the electrical connection state of the ID pin of an external micro-USB port. That is, if the ID pin is connected to the smart phone in the state in which it has been electrically connected to a ground (GND) pin, the smart phone operates as a host. If the ID pin is connected to the smart phone in a floating state in which it has not been electrically connected to any node, the smart phone operates as a device. In the micro-USB port embedded in the USB OTG memory stick, a smart phone operates as a host when the USB OTG memory stick is connected to the smart phone because the ID pin has been electrically connected to a GND pin.

The ID pin of the micro-USB port embedded in a cable that connects a smart phone and a PC through a micro-USB port is not electrically connected to other pins, but has been floated. Accordingly, when the smart phone is connected to the PC, the smart phone operates as a device.

Accordingly, when the ID pin on the part of the first hearing aid device 310 of the micro-USB port that connects the first hearing aid device 310 and smart phone 200 of FIG. 2 is connected to the GND pin and the first hearing aid device 310 is connected to the smart phone 200, the smart phone 200 operates as a host. A digital audio signal and data are downloaded from the smart phone 200 to the first hearing aid device 310 through the micro-USB port, and a signal is transmitted from the first hearing aid device 310 to the smart phone 200, thus controlling the operation of the smart phone 200.

Figure 5:
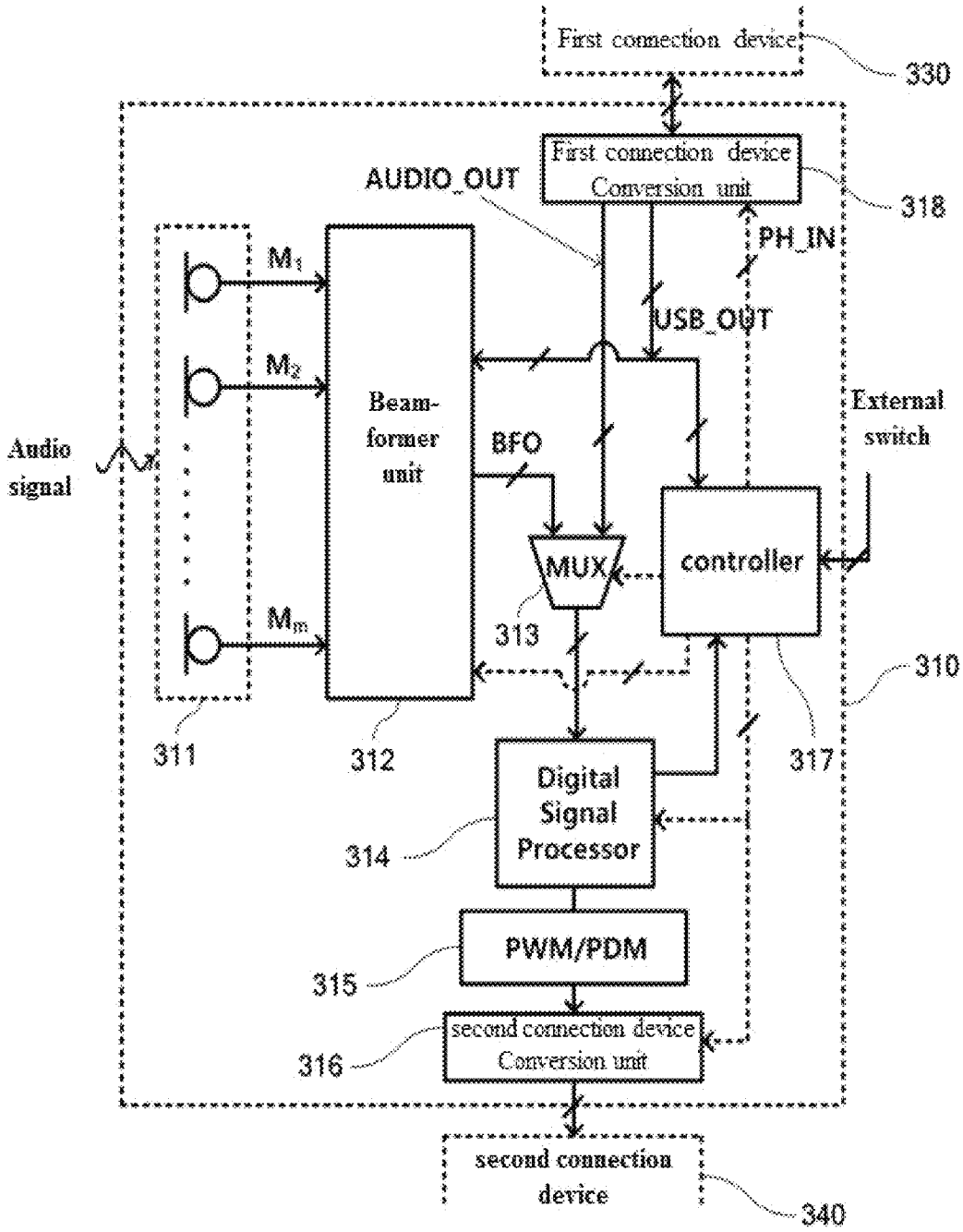
FIG. 5 is a diagram illustrating the configuration of the first hearing aid device in the hearing aid attached to a mobile electronic device in accordance with an embodiment of the present disclosure.

FIG. 5 is a diagram illustrating the configuration of the first hearing aid device 310 in the hearing aid attached to a mobile electronic device in accordance with an embodiment of the present disclosure.

The first hearing aid device 310 of the smart phone attachment type hearing aid in accordance with an embodiment of the present disclosure includes a microphone array 311, a beamformer unit 312, a first connection device conversion unit 318, a MUX 313, a digital signal processor 314, a modulation signal generation unit (PWM/PDM) 315, a second connection device conversion unit 316, and a controller 317.

The microphone array 311 including m microphones M1, M2, . . . , Mm installed on the outside surface of the smart phone casing is connected to the beamformer unit 312. The first connection device 330 denotes a micro-USB port cable that connects the micro-USB port of the smart phone and the first hearing aid device 310. The second connection device 340 denotes a wired cable or a wireless transmission device that connects the second hearing aid device 320 including a speaker, such as an earphone placed in an ear of a user, and the first hearing aid device 310.

The digital signal processor 314 selects one of the output signal BFO of the beamformer unit 312 and a telephone sound output data signal AUDIO_OUT as an input, performs signal processing for the hearing aid on the selected signal, and sends an audio signal, that is, a result of the signal processing, to the modulation signal generation unit 315. The modulation signal generation unit 315 modulates the audio signal in a pulse width modulation (PWM) or pulse density modulation (PDM) form and sends the modulated signal to the second connection device conversion unit 316.

The controller 317 may control the operations of all the parts of the first hearing aid device 310 and also control the operation of the smart phone in response to an external input signal received through an external switch installed in the smart phone casing, a control signal received from the smart phone through the first connection device 330, or an input signal received from the digital signal processor 314.

The first hearing aid device 310 is connected to the first connection device 330 through the first connection device conversion unit 318 and connected to the second connection device 340 through the second connection device conversion unit 316.

During a data transmission/reception operation through the first connection device conversion unit 318 and the first connection device 330 of FIG. 5, when a control signal is transmitted from the first hearing aid device 310 to the smart phone 200 or the first hearing aid device 310 downloads a control signal or a parameter value for the beamformer unit 312 from the smart phone 200, a USB communication method using signals PH_IN and USB_OUT is used. When the first hearing aid device 310 receives telephone voice data output from the smart phone 200, a mobile high definition link (MHL) communication method using the sound output data signal AUDIO_OUT is used. The MHL communication method has recently been developed in order to watch the display output and speaker output of a smart phone in TV through the existing micro-USB port or lightning port even without adding a new data input/output port to the smart phone.

Figure 6:
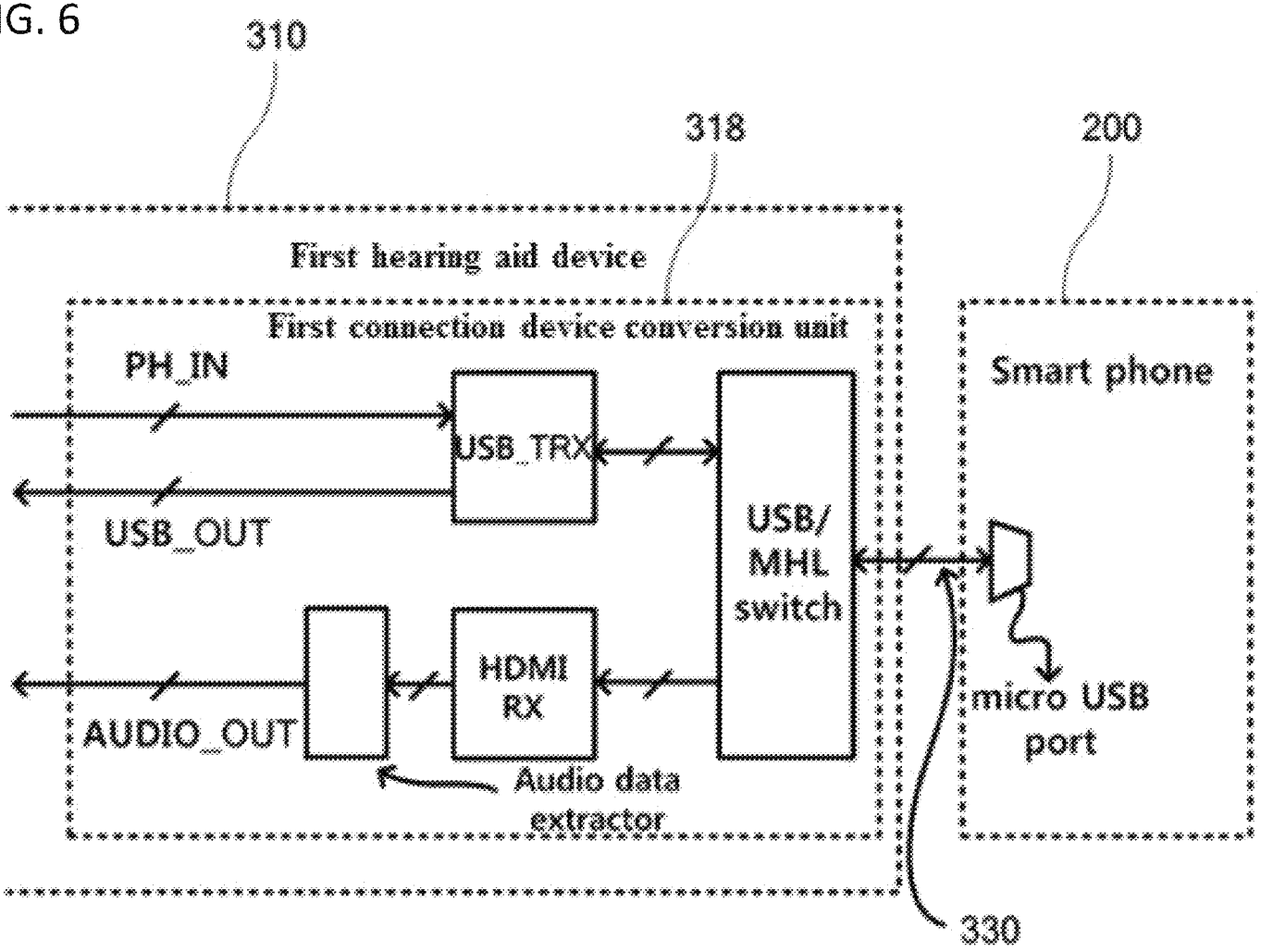
FIG. 6 is a conceptual diagram of a first connection device conversion unit included in the first hearing aid device and a first connection device.

FIG. 6 is a conceptual diagram of the first connection device conversion unit 318 included in the first hearing aid device 310 and the first connection device 330.

The first connection device conversion unit 318 includes a USB/MHL switch, a USB transceiver USB_TRX, a high definition multimedia interface (HDMI) receiver HDMI_RX, and an audio data extractor.

The HDMI receiver alternately outputs a video signal and an audio signal in order of time and the audio data extractor extracts only audio data from the output of the HDMI receiver. Accordingly, not only a counterpart voice when a telephone call output from the smart phone is made, but all the audio signals played back in the speaker of the smart phone are controlled according to the ear characteristics of a user through the digital signal processor 314 of the first hearing aid device 310 and transferred to an ear of the user. Accordingly, the user can clearly hear the counterpart voice and all the audio signals.

The first connection device 330 is a USB cable that connects the micro-USB port of the smart phone 200 and the first hearing aid device 310. The 5-pin micro-USB port supports a USB 2.0 standard in which maximum data transfer speed is 480 Mbps.

Figure 7:
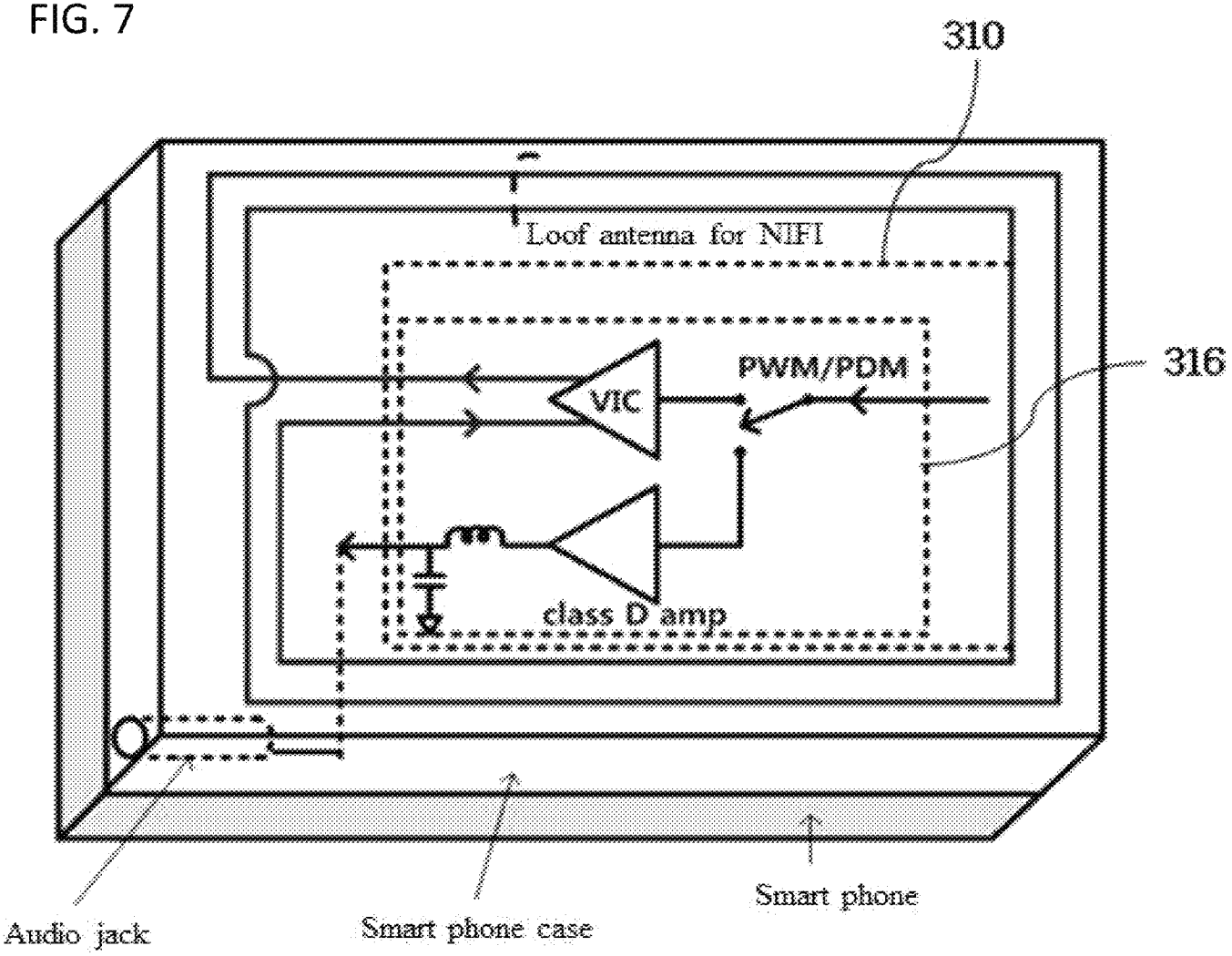
FIG. 7 is a diagram illustrating a second connection device conversion unit and a second connection device in accordance with an embodiment of the present disclosure.

FIG. 7 is a diagram illustrating the second connection device conversion unit 316 and the second connection device 340 in accordance with an embodiment of the present disclosure.

The second connection device 340 is a device that connects the first hearing aid device 310 and the second hearing aid device 320 or the first hearing aid device 310 and the third hearing aid device 350, and uses a wired cable or a wireless transmission method, such as Bluetooth or digital near field magnetic induction (NFMI). The Bluetooth wireless transmission method has much greater power consumption than the digital NFMI wireless transmission method. For this reason, both the NFMI wireless transmission method and the wired transmission method are used in an embodiment of the present disclosure.

A digital PWM/PDM modulation signal, that is, the output of the modulation signal generation unit 315 of the first hearing aid device 310, is applied to a voltage-to-current converter (VIC) to drive an NFMI loop antenna so that the digital PWM/PDM modulation signal is output as a change of a magnetic field. Alternatively, the digital PWM/PDM modulation signal is applied to a class D amplifier, converted into an audible audio signal through an LC low bandpass filter, and output to a standard audio jack.

In the wired transmission method, an audio cable is connected to the audio jack. In the digital NFMI wireless transmission method, a PWM/PDM modulation signal of about 10 MHz is transmitted using a magnetic field, and the magnetic field is detected by the second hearing aid device 320. In general, the transmission distance of an NFMI magnetic field is limited to 50 cm or less because the intensity of the NFMI magnetic field inversely proportional to the cube of the distance for a low frequency signal. The NFMI loop antenna is formed of a metal conducting wire loop and is not exposed to the outside because it is placed inside the smart phone casing.

The second connection device 340 in accordance with an embodiment of the present disclosure denotes the digital NFMI wireless connection method or an audio cable connected to the audio jack. Referring to FIG. 7, the audio jack is placed at the corner of the smart phone casing. In this case, the thickness of the entire device can be minimized when the first hearing aid device 310 is mounted on the smart phone casing because the audio jack is placed at a place where the smart phone is not present when the smart phone casing is inserted into the smart phone.

Figure 8:
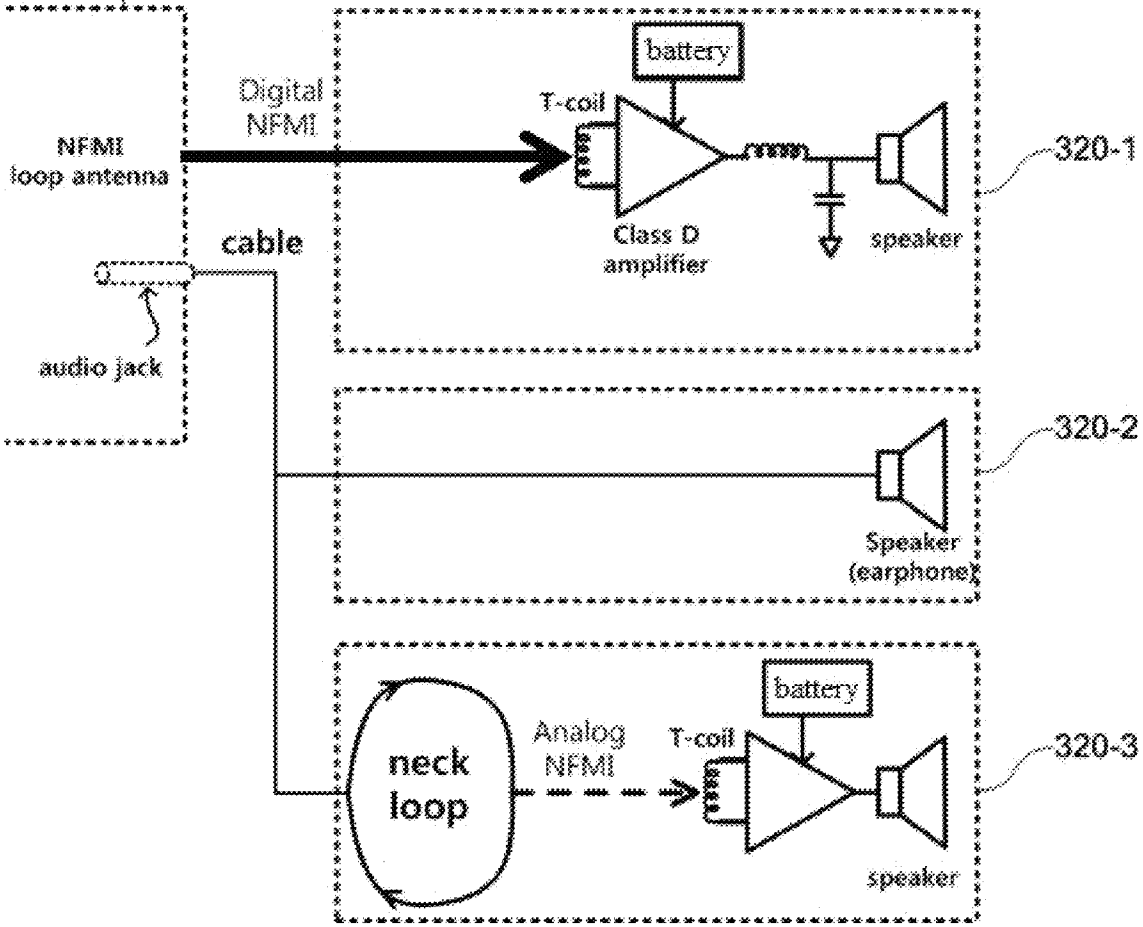
FIG. 8 is a conceptual diagram of the second hearing aid device and the second connection device in accordance with an embodiment of the present disclosure.

FIG. 8 is a conceptual diagram of the second hearing aid device 320 and the second connection device 340 in accordance with an embodiment of the present disclosure.

As illustrated in FIG. 8, the second hearing aid device 320 in accordance with an embodiment of the present disclosure is divided into three types: a (2-1)-th hearing aid device 320-1, a (2-2)-th hearing aid device 320-2, and a (2-3)-th hearing aid device 320-3 depending on a connection method with the second connection device 340.

The (2-1)-th hearing aid device 320-1 is used when the second connection device 340 uses the digital NFMI wireless connection method. The (2-1)-th hearing aid device 320-1 converts a change of a received NFMI magnetic field into a change of a voltage using a T-coil, converts the voltage into an audible audio signal by passing the voltage through the class D amplifier and the LC low bandpass filter, thereby driving the speaker.

The (2-2)-th hearing aid device 320-2 and the (2-3)-th hearing aid device 320-3 are used when the second connection device 340 is an audio cable connected to the audio jack. The earphone (or speaker) of the (2-2)-th hearing aid device 320-2 is directly connected to the audio cable in order to hear a sound. In the (2-3)-th hearing aid device 320-3, an audio cable is connected to a neck loop in order to transfer an audible audio signal of the earphone of the (2-3)-th hearing aid device 320-3 using an analog NFMI method, and thus the audible audio signal is transferred to the T-coil of the (2-3)-th hearing aid device 320-3. A signal detected in the T-coil is amplified, thereby driving the earphone (or speaker).

Figure 9:
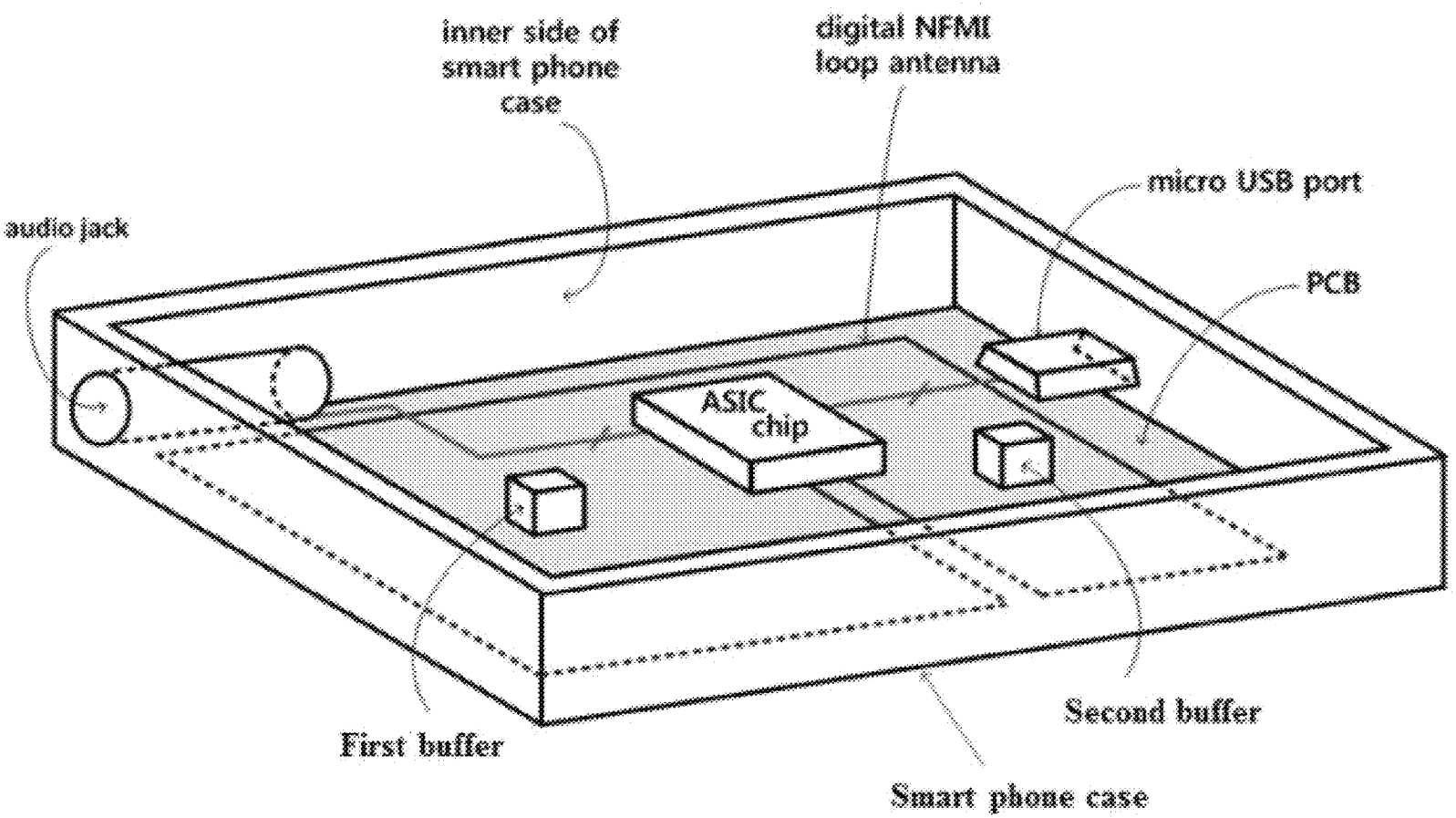
FIG. 9 is a diagram illustrating that the first hearing aid device in accordance with an embodiment of the present disclosure is embedded in a smart phone casing.

FIG. 9 is a diagram illustrating that the first hearing aid device 310 in accordance with an embodiment of the present disclosure is embedded in the smart phone casing.

As illustrated in FIG. 9, all the circuits that belong to the elements of the first hearing aid device 310 and that are other than the microphone array 311 and some passive elements (e.g., a resistor, an inductor, and a capacitor) are implemented within a single application specific integrated circuit (ASIC) chip. Accordingly, the power consumption and volume of the first hearing aid device 310 can be minimized.

The ASIC chip includes the beamformer unit 312, the digital signal processor 314, the modulation signal generation unit 315, the controller 317, the MUX 313, the first connection device conversion unit 318, and the second connection device conversion unit 316. A hole for the microphone array 311 is formed at the bottom surface of the smart phone casing of FIG. 9.

All of the microphone array 311, the ASIC chip, the passive elements, the loop antenna for digital NFMI, and the audio jack are disposed on a single PCB. That is, the ASIC chip, the loop antenna, and the audio jack are disposed on one surface of the PCB and the microphone array is disposed on the other surface of the PCB so that the microphone array location are matched with the locations of the holes perforated in the smart phone casing.

In order to efficiently obtain an external audio signal, the microphones of the microphone array are externally exposed through the hole formed in the smart phone casing. In order for other people to rarely notice that the hearing aid is being used, the color or pattern of the microphones exposed through the hole formed in the smart phone casing is made identical with or similar to that of the smart phone casing so that the microphones are rarely distinguished from the smart phone casing. In order to protect the outer surface of the smart phone casing through which the microphones are exposed, a thin cloth or film through which a sound passes is placed on the outer surface of the smart phone casing.

The location of the audio jack in the smart phone casing may be disposed at a corer location of the smart phone casing into which the smart phone is not inserted in order to minimize a total thickness of a device. Furthermore, a plurality of buffers may be attached to the top of the PCB in order to prevent the circuits of the first hearing aid device 310 placed on the PCB from being influenced by a mechanical impact when the smart phone casing is inserted into the smart phone.

Figure 10:
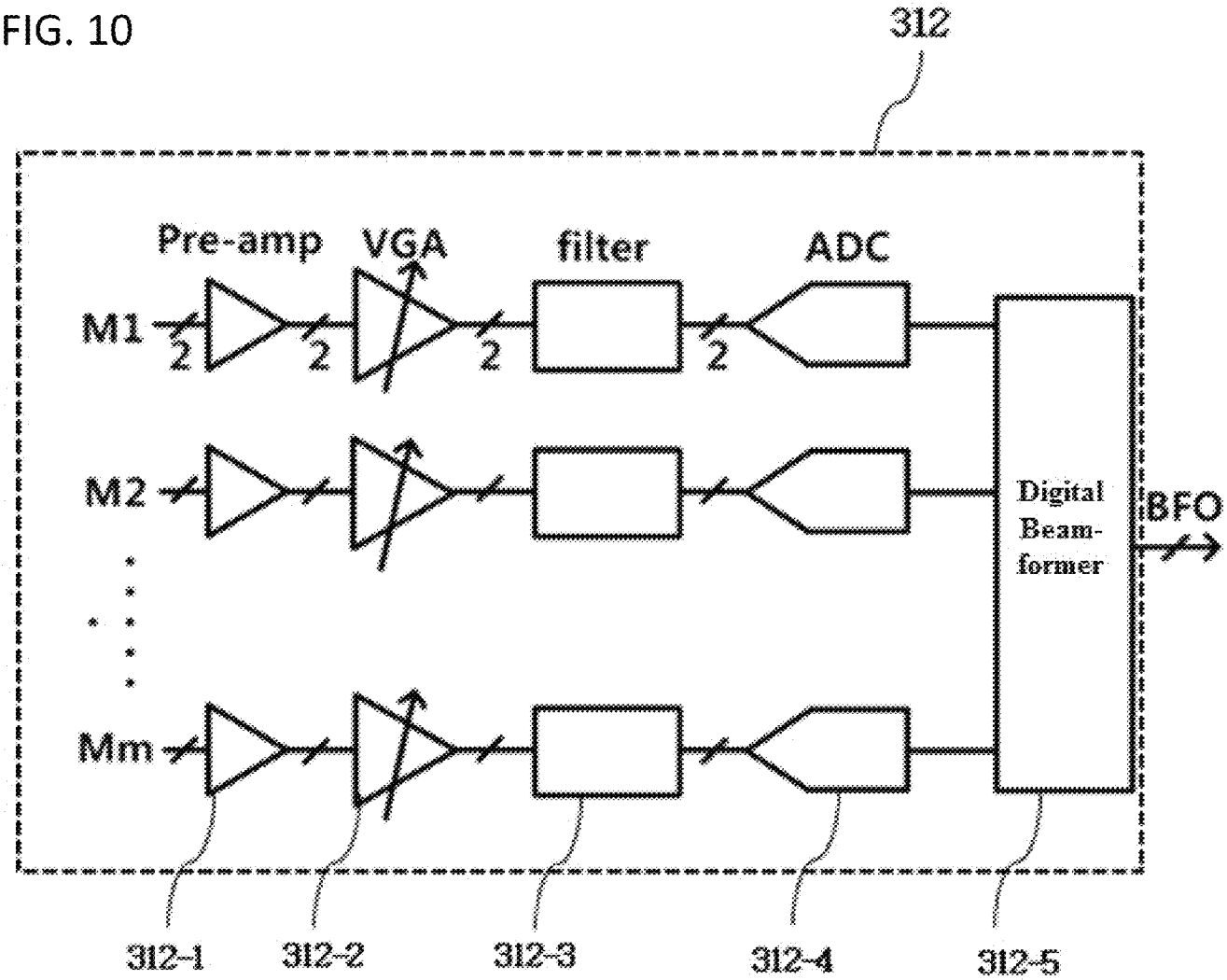
FIG. 10 is a detailed diagram of the beamformer unit of the first hearing aid device in accordance with an embodiment of the present disclosure.

FIG. 10 is a detailed diagram of the beamformer unit 312 of the first hearing aid device 310 in accordance with an embodiment of the present disclosure.

The beamformer unit 312 receives m output signals from the microphone array formed of the m microphones $M_1$, $M_2$, . . . , $M_m$, performs analog signal processing on the m output signals, converts the analog signals into digital signals, and outputs a beamformed result signal BFO. In this case, if the number of microphones is increased, a signal to noise ratio is increased due to improved directivity.

In an existing hearing aid, the number of microphones mounted on the hearing aid is limited to 2 or 3 due to the limited size. In an embodiment of the present disclosure, the number m of microphone may be 4 or more.

From FIG. 10, it may be seen that the beamformer unit 312 includes m channels and a single digital beamformer 312-5. The digital beamformer 312-5 may include a finite impulse response (FIR) filter.

Each of the channels includes one pre-processing amplifier (Pre-amp), one variable gain amplifier (VGA), one anti-aliasing filter, and one analog-to-digital converter (ADC) with the two input nodes of a pre-amp connected to the two terminals of an electret microphone through several passive elements (e.g., a resistor and a capacitor).

All of the Pre-amp 312-1, the VGA 312-2, the filter 312-3, and the ADC 312-4 are formed of fully-differential circuits in order to reduce the influence of a digital noise. The output signals of the ADCs of the respective channels are merged in the digital beamformer 312-5 after a lapse of different predetermined delay times and then output as the result signal BFO.

Figure 11:
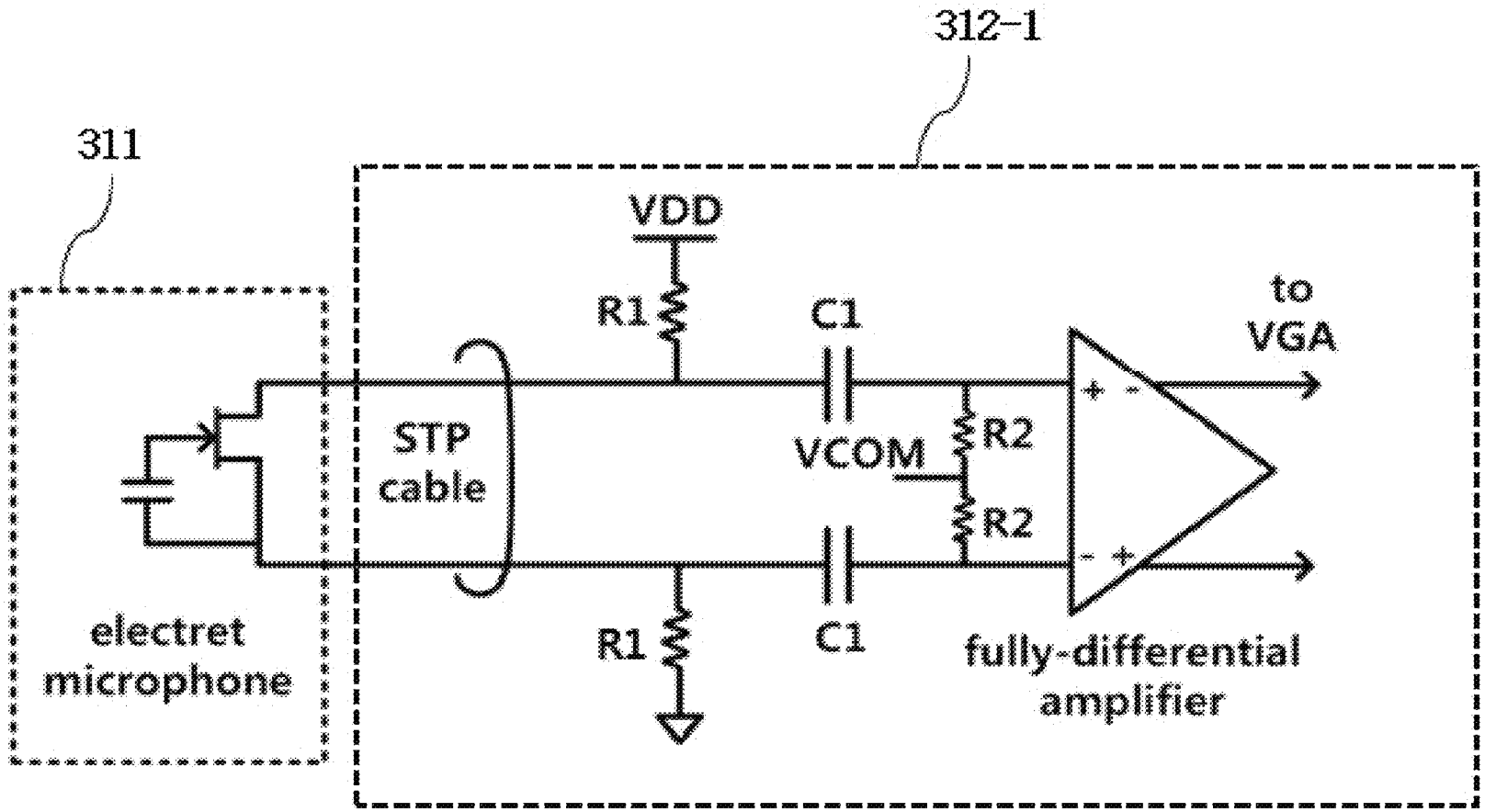
FIG. 11 is a diagram illustrating the pre-processing amplifier of the beamformer unit of the first hearing aid device in accordance with an embodiment of the present disclosure.

FIG. 11 is a diagram illustrating the Pre-amp 312-1 of the beamformer unit 312 of the first hearing aid device 310 in accordance with an embodiment of the present disclosure.

A shielded twisted pair (STP) cable is used as a cable connected to the microphone array 311. In this case, two signal conducting wires are surrounded by a net-structured ground conducting wire, thereby reducing the influence of an external noise. In FIG. 11, two resistors R1 have the same value, and each of two resistors R2 and two capacitors C1 also has the same value. In order to further reduce the influence of an external noise, the microphone circuit is configured to have a differential structure, and a differential analog signal is supplied as an input to the Pre-amp 312-1.

In an embodiment of the present disclosure, a beamforming operation is performed using the microphone array disposed on the outer face of the smart phone casing in a two-dimensional manner. Prior to a description of the two-dimensional beamforming operation, a beamforming operation using a one-dimensional microphone array is described below.

Figure 12:
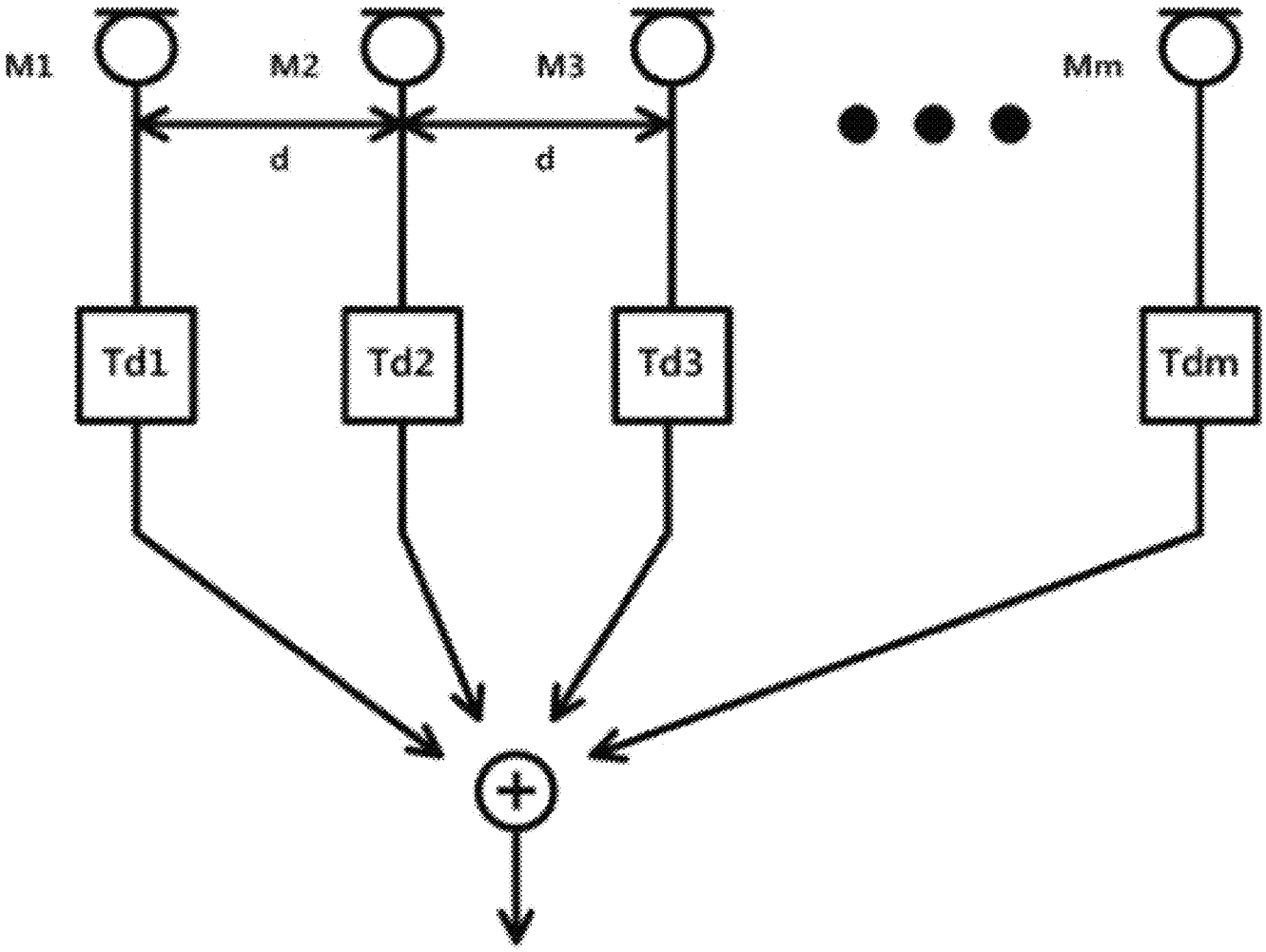
FIG. 12 is a conceptual diagram a one-dimensional beamforming operation.
Figure 13:
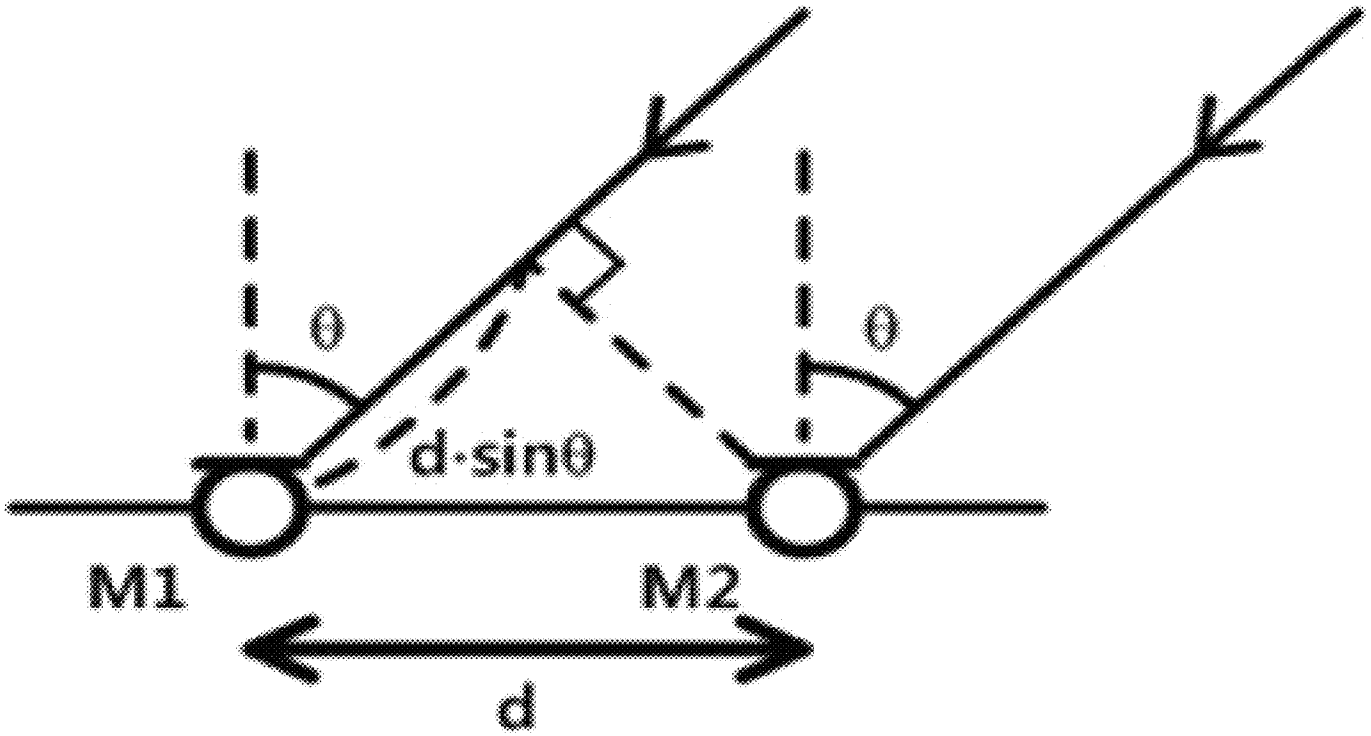
FIG. 13 is a diagram illustrating a difference between unit delay times in one-dimensional beamforming.

FIG. 12 is a conceptual diagram of the one-dimensional beamforming operation, and FIG. 13 is a diagram illustrating a difference in delay times between two adjacent microphones in the one-dimensional beamforming operation.

In FIG. 12, all the microphones $M_1$, $M_2$, . . . , $M_m$ are disposed on a straight line at a regular interval, and the distance between adjacent microphones is d. If the distance between a sound source and the microphone array is much greater than a total length of the microphone array, an sound wave may be assumed to be a plane wave.

A difference in the time that is taken for a plane sound wave to reach two microphones spaced apart from each other at the distance "d" is $(d/c)\cdot\sin(\theta)$ as illustrated in FIG. 13. In this case, is an angle formed by the propagation direction of the plane sound wave and the vertical line of the microphone array direction. "c" is the propagation velocity of the sound wave. To focus on the plane sound wave that is propagated from the direction of θ target, the delay times of delay elements Td1, Td2, . . . , Tdm illustrated in FIG. 12 may be set as in Equation 1 below. In this case, only if the value θ of the propagation direction of the plane sound wave is equal to a value $\theta_{target}$, all the sound signals passing through the delay elements Td1, Td2, . . . , Tdm have the same phase. Accordingly, an added signal has great amplitude. If the value θ is different from the value $\theta_{target}$, the sound signals passing through the delay elements have different phases. As a result, an added signal has smaller amplitude.

$$\text{delay } (Td1) = (m-1)\cdot\frac{d}{c}\cdot\sin(\theta_{target}) \quad (1)$$

$$\text{delay } (Td2) = (m-2)\cdot\frac{d}{c}\cdot\sin(\theta_{target})$$

$$\ldots$$

$$\text{delay } (Tdi) = (m-i)\cdot\frac{d}{c}\cdot\sin(\theta_{target})$$

$$\ldots$$

$$\text{delay } (Tdm) = 0$$

A two-dimensional beamforming operation is described below.

Figure 14:
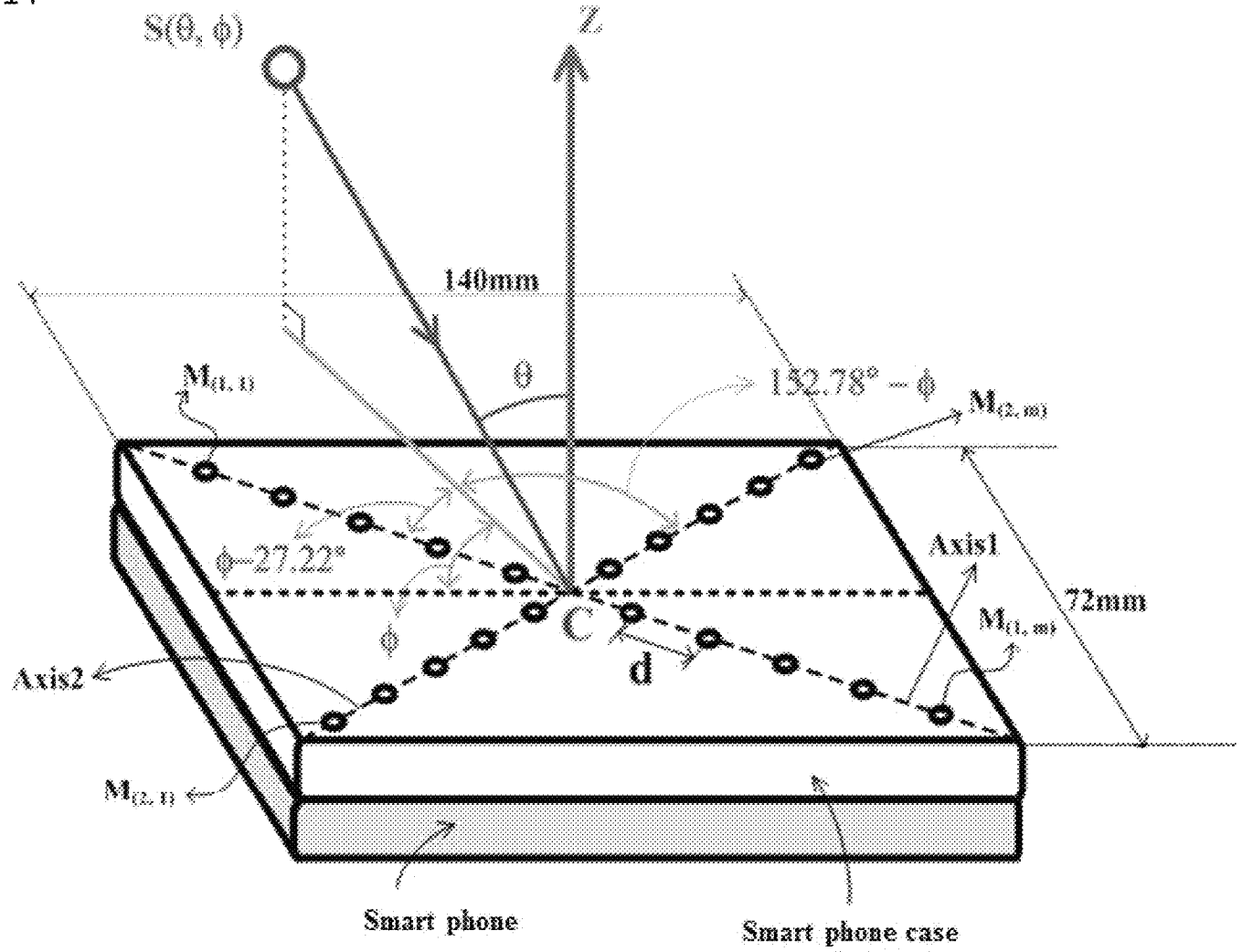
FIG. 14 is a diagram illustrating a two-dimensional microphone array in accordance with an embodiment of the present disclosure.

FIG. 14 is a diagram illustrating a two-dimensional microphone array in accordance with an embodiment of the present disclosure.

As illustrated in FIG. 14, in an embodiment of the present disclosure, in order to implement the two-dimensional microphone array, the microphones are disposed at a regular interval on a straight line in the two diagonal directions Axis1 and Axis2 of the smart phone casing. The smart phone casing is 140 mm in a horizontal length and 72 mm in a vertical length. The distance between two microphones adjacent to each other in each of the two diagonal lines is the same, that is, "d".

In an embodiment of the present disclosure, the distance "d" is 20 mm. In order to define the spherical coordinates r, θ, and Ø with respect to the two-dimensional microphone array of FIG. 14, a direction (i.e., a z axis) vertical to the plane of the microphone array is set to "θ=0". A left direction in a straight line that passes through a central point C, that is, a place where the first axis Axis1 and the second axis Axis2 are met, and that is parallel to a horizontal direction, that is, the longer direction of the horizontal and vertical directions of the smart phone casing, is set to "θ=0". The central point C is set to be identical with the central location of the smart phone casing.

A difference in the time that is taken for a plane wave sound signal S incident in a direction (θ,Ø) to reach two adjacent microphones that belong to microphones $M_{(1,1)}, M_{(1,2)}, \ldots, M_{(1,m)}$ and that are placed on the first axis Axis1 is (d/c)·sin(θ)·cos(Ø−27.22°) A difference in the time that is taken for the plane wave sound signal S to reach two adjacent microphones that belong to microphones $M_{(2,1)}, M_{(2,2)}, \ldots, M_{(2,m)}$ and that are placed on the second axis Axis2 is (d/c)·sin(θ)·cos(152.78°−Ø).

Accordingly, if only a plane wave sound signal incident in a direction ($\theta_{target}$, $Ø_{target}$) is to be heard, the output signals of the respective microphones of FIG. 14 have only to be relatively delayed by respective delay times of Equation 2 and then added up.

$$\text{delay}(M_{(1,1)}) = \frac{(m-1)}{2}\cdot\frac{d}{c}\cdot\sin(\theta_{target})\cdot\cos(Ø_{target}-27.22°) \quad (2)$$

$$\text{delay}(M_{(1,2)}) = \frac{(m-3)}{2}\cdot\frac{d}{c}\cdot\sin(\theta_{target})\cdot\cos(Ø_{target}-27.22°)$$

$$\ldots$$

$$delay\ (M_{(1,m-1)}) = \frac{-(m-3)}{2}\cdot\frac{d}{c}\cdot\sin(\theta_{target})\cdot\cos(Ø_{target}-27.22°)$$

$$\text{delay } (M_{(1,m)}) = \frac{-(m-1)}{2}\cdot\frac{d}{c}\cdot\sin(\theta_{target})\cdot\cos(Ø_{target}-27.22°)$$

$$\text{delay } (M_{(2,1)}) = \frac{(m-1)}{2}\cdot\frac{d}{c}\cdot\sin(\theta_{target})\cdot\cos(152.78°-Ø_{target})$$

-continued $$\text{delay } (M_{(2,2)}) = \frac{(m-3)}{2}\cdot\frac{d}{c}\cdot\sin(\theta_{target})\cdot\cos(152.78°-Ø_{target})$$

$$\ldots$$

$$\text{delay } (M_{(2,m-1)}) = \frac{-(m-3)}{2}\cdot\frac{d}{c}\cdot\sin(\theta_{target})\cdot\cos(152.78°-Ø_{target})$$

$$\text{delay } (M_{(2,m)}) = \frac{-(m-1)}{2}\cdot\frac{d}{c}\cdot\sin(\theta_{target})\cdot\cos(152.78°-Ø_{target})$$

A method of using the smart phone attachment type hearing aid in accordance with an embodiment of the present disclosure is described below.

FIG. 15 is a diagram illustrating a method of using a smart phone attachment type hearing aid in accordance with an embodiment of the present disclosure.

Figure 15A:
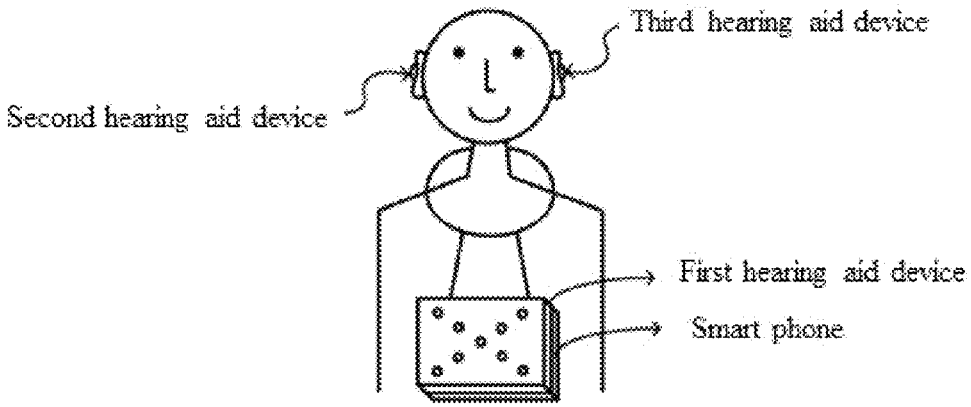
FIGS. 15A and 15B are diagrams illustrating a method of using a smart phone attachment type hearing aid in accordance with an embodiment of the present disclosure.
Figure 15B:
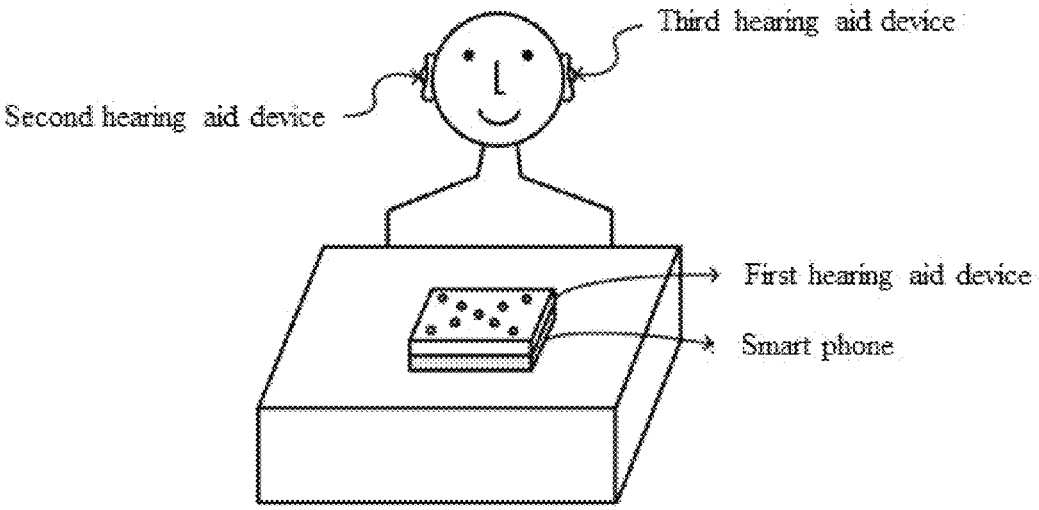

In FIG. 15A and FIG. 15B, in order to well perform a beamforming operation, the direction of the first hearing aid device 310 is required to maintain a constant angle with respect to the direction of the body of a user. FIG. 15A is an example in which the user stands up. In this case, the direction on the longer side of the first hearing aid device 310 is parallel to the ground, and the direction vertical to the microphone array is identical with the direction to which the body is directed. That is, the direction to which the body is directed is θ=0.

FIG. 15B is an example in which the user sits at a desk. The direction vertical to the microphone array is vertical to the direction to which the body is directed (i.e., $\theta_{target}$=90°). If the user is to talk with a counterpart who stands up as in the case of FIG. 15A, $\theta_{target}$ may be set to about 30°. If the user is to talk with a counterpart who stands ahead as in the case of FIG. 15B, $\theta_{target}$ may be set to about 60°.

Figure 16:
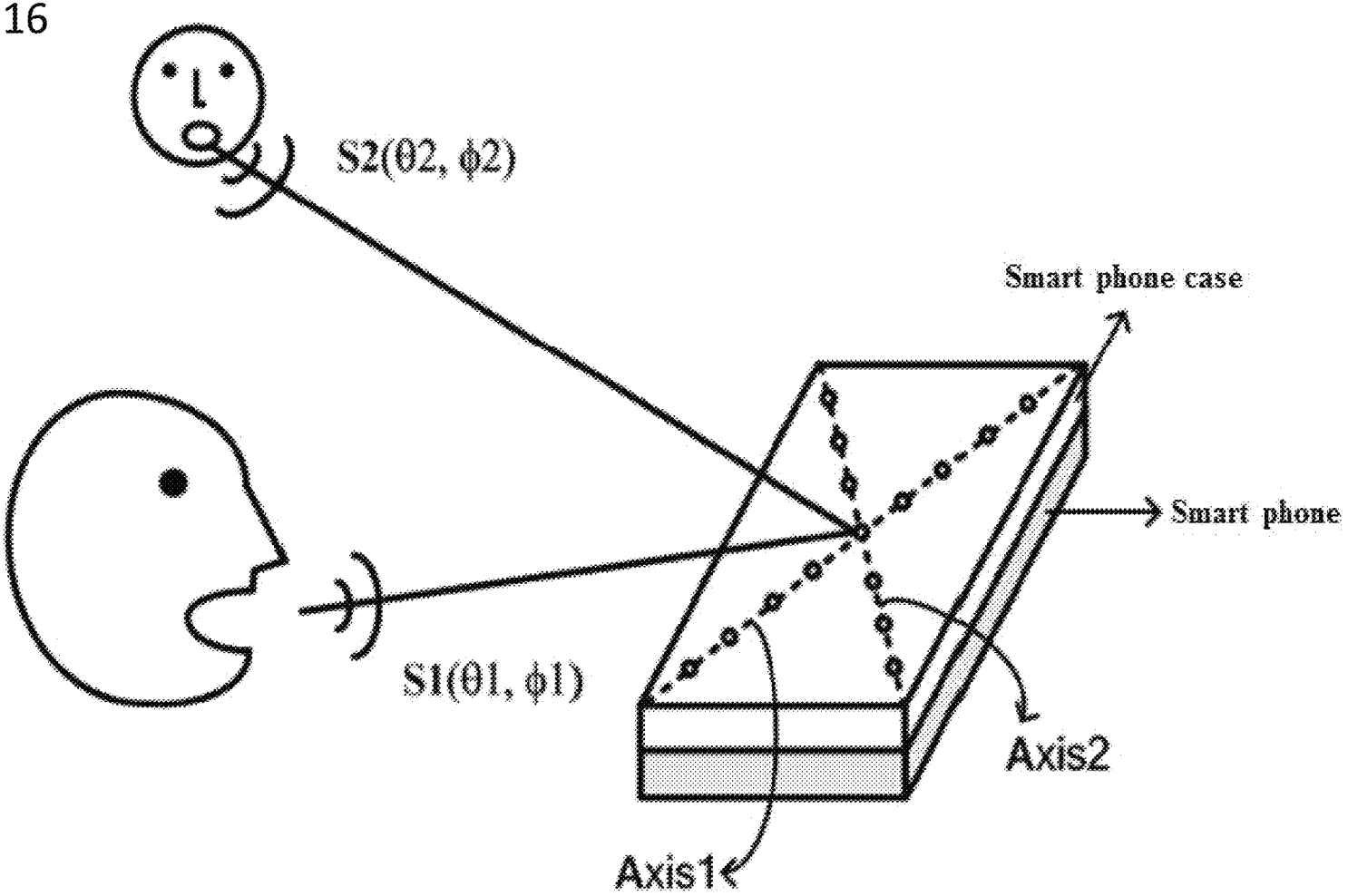
FIG. 16 is a diagram illustrating beamforming using the first hearing aid device when two sound sources are present.

FIG. 16 is a diagram illustrating beamforming using the first hearing aid device 310 when two sound sources are present.

As illustrated in FIG. 16, assuming that two sound source $S_1$ incident in a direction ($\theta_1$,$Ø_1$) and $S_2$ incident in a direction ($\theta_2$,$Ø_2$) are present, if only the sound source $S_1$ is to be heard, $\theta_{target}=\theta_1$ and $Ø_{target}=Ø_1$ and then the delay times of Equation 2 have only to be applied to the output signals of the microphone array and added up.

FIG. 17 is a diagram illustrating beamforming characteristics with respect to Ø for 3 different frequency values of audio signals in the case of $Ø_{target}$=90° in accordance with an embodiment of the present disclosure.

Figure 17A:
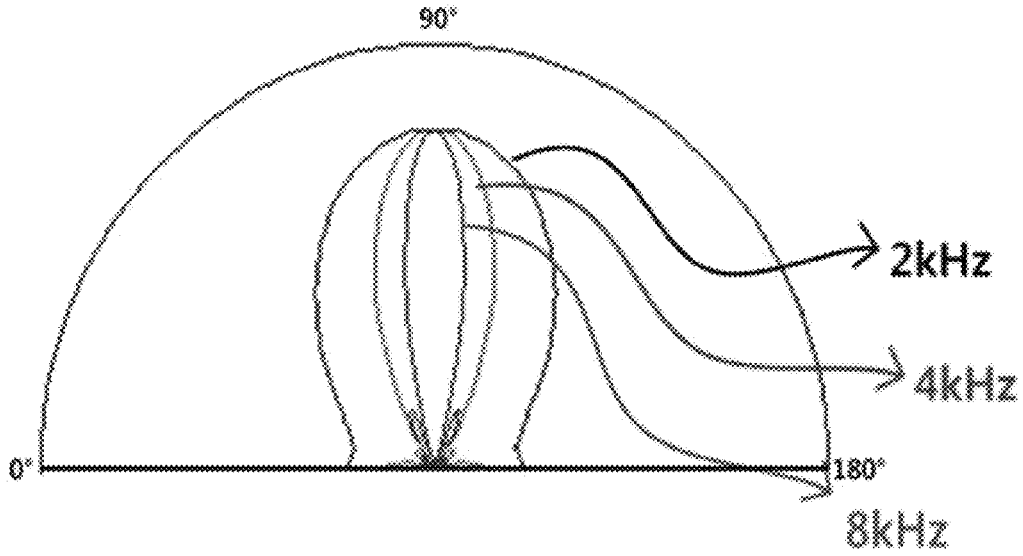
FIGS. 17A and 17B are diagrams illustrating beamforming characteristics with respect to the frequencies of audio signals in the case of $Ø_{target}$=90° in accordance with an embodiment of the present disclosure.
Figure 17B:
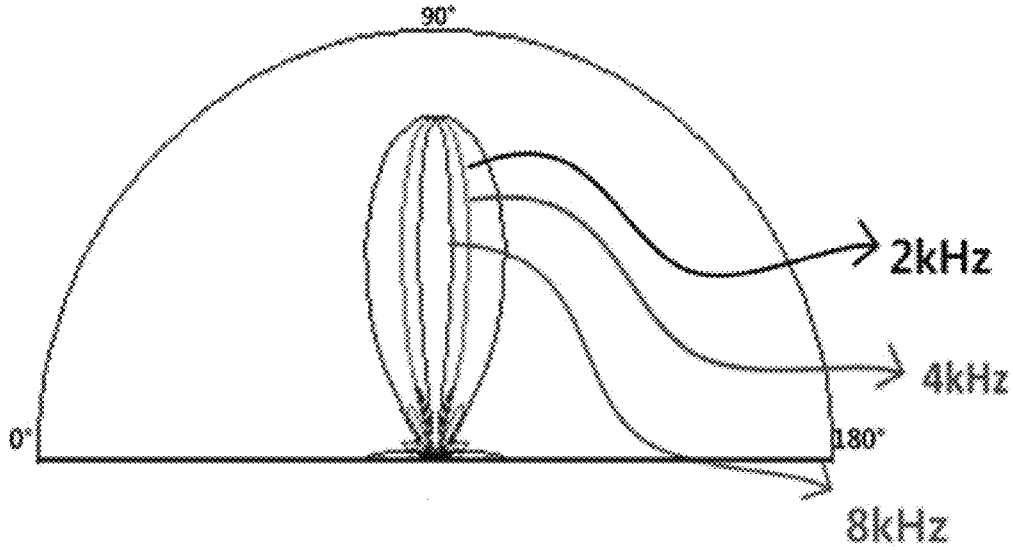

In order to statistically illustrate the beamforming characteristics, the target direction of an audio to be heard was set to $Ø_{target}$=90°, and the polar coordinate graphs of the beamforming characteristics with respect to Ø for θ=30° and θ=60° are illustrated in FIGS. 17A and 17B.

In this case, m=16, and a total of 32 microphones were used, and the frequencies 2 kHz, 4 kHz, and 8 kHz of audio signals were used. From FIG. 17, it may be seen that a beamforming operation is well performed as the audio signal frequency is increased. Since the distance between two adjacent microphones is 20 mm, a maximum audio signal frequency in which aliasing is not generated is 8.5 kHz.

Figure 18:
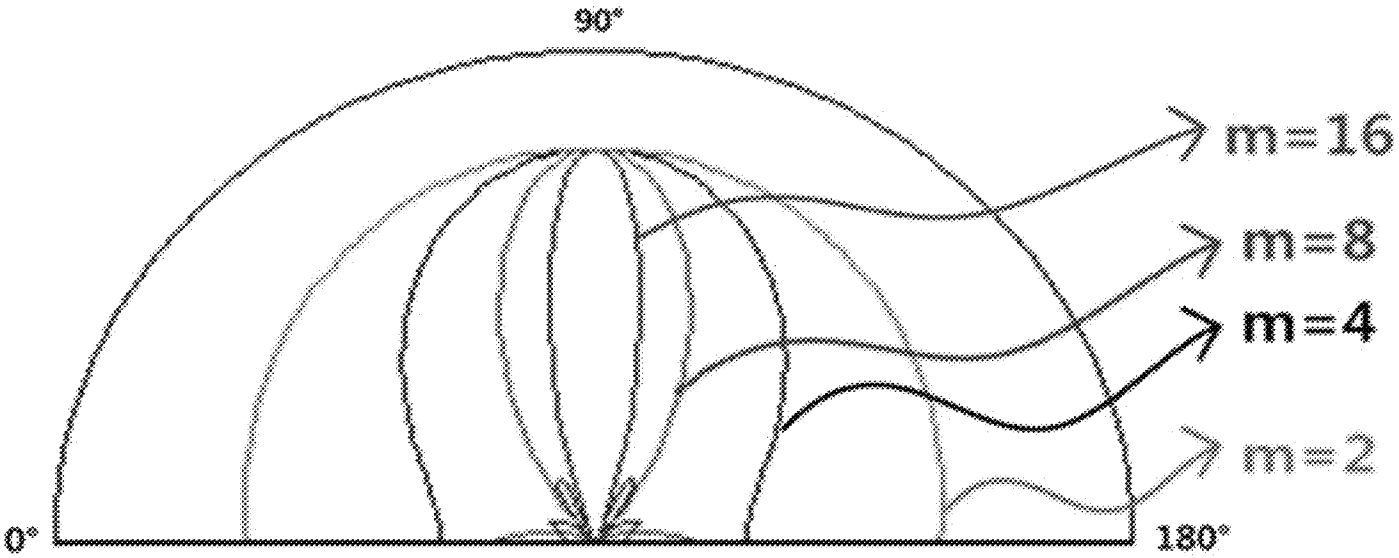
FIG. 18 is a diagram illustrating beamforming characteristics with different number of microphones is different at $Ø_{target}$=90°, θ=60°, and an audio signal frequency of kHz in accordance with an embodiment of the present disclosure.

FIG. 18 is a diagram illustrating beamforming characteristics with respect to Ø for different number of microphones at $Ø_{target}$=90°, θ=60°, and an audio signal frequency of 4 kHz in accordance with an embodiment of the present disclosure.

FIG. 18 illustrates the beamforming characteristics obtained when an audio signal frequency was set to 4 kHz with $Ø_{target}$=90° and θ=60° and the number of microphones is, 32 (m=16), (m=8), 8 (m=4), and 4 (m=2), in order to monitor a change of beamforming characteristics with the number of microphones. It may be seen that a beamforming operation is well performed when "m" is 4 or more.

In an embodiment of the present disclosure, in order to perform beamforming with respect to θ and Ø, the microphones are disposed on the two diagonal lines. In order to perform beamforming with respect to only Ø, the microphones may only to be disposed on one diagonal line. In the case of the beamforming with respect to Ø, the same beamforming characteristics can be obtained although the number of microphones is reduced by half compared to the beamforming with respect to θ and Ø.

In accordance with the hearing aid attached to a mobile electronic device according to an embodiment of the present disclosure, there are advantages in that other people rarely notice that a user uses the hearing aid because the first hearing aid device 310 is mounted on the casing of a mobile electronic device and a beamforming operation using the microphone array is possible because the hearing aid is as large size as a smart phone.

Furthermore, for signals with frequencies of 3 kHz~5 kHz, that is, frequency bands which can be most heard by a person through the microphone array and beamforming hardware, only an audio signal component in a required direction other than a background noise can be clearly heard.

The first hearing aid device 310 does not require a battery because it is supplied with power from a battery with a relatively high capacity embedded in a smart phone. If the second hearing aid device 320 and the first hearing aid device 310 are connected by a wire, the second hearing aid device 320 also does not require a battery. If the second hearing aid device 320 and the first hearing aid device 310 are connected using a wireless method, such as NFMI or Bluetooth, a battery needs to be added to the second hearing aid device 320. In this case, a small battery, such as a zinc-air battery, may be used.

Furthermore, in accordance with an embodiment of the present disclosure, the first hearing aid device 310 and the smart phone are connected using a wired digital interface.

Accordingly, a counterpart's voice received through a smart phone is subjected to digital signal processing in the first hearing aid device 310, controlled according to the ear characteristics of a user, and transferred to the second hearing aid device 320, such as an earphone. Accordingly, the user can clearly hear the counterpart's voice.

Use convenience and level of satisfaction of the hearing aid can be improved because a user can autonomously control the parameter values of the first hearing aid device 310 according to his or her ear characteristics using an app program installed in a smart phone.

Furthermore, there are advantages in that the acoustic feedback removal function is not required and the size of a hearing aid-dedicated ASIC chip can be reduced because the acoustic feedback phenomenon is obviated by increasing the distance between the smart phone casing on which the microphone array is mounted and the second hearing aid device 320 on which the speaker (or earphone) is mounted.

While various embodiments have been described above, it will be understood to those skilled in the art that the embodiments described are by way of example only. Accordingly, the disclosure described herein should not be limited based on the described embodiments.

What is claimed is:

1. A hearing aid attached to a mobile electronic device, comprising:

a first hearing aid device configured to convert an external audio signal into an audio signal suitable for hearing characteristics of a user by processing the external audio signal and output the converted audio signal; and a second hearing aid device configured to comprise a speaker and placed in an ear of the user, wherein the first hearing aid device is mounted on a casing of the mobile electronic device and connected to the mobile electronic device through a first connection device, and the second hearing aid device is connected to the first hearing aid device through a second connection device, and wherein the first hearing aid device comprises:

a microphone array configured to receive the external audio signal;

a beamformer unit configured to receive a plurality of output signals of the microphone array and output a beamformer unit output signal;

a MUX configured to select one of the beamformer unit output signal and a sound output data signal from the mobile electronic device and output the selected signal;

a digital signal processor configured to receive the output signal of the MUX, perform signal processing on the received signal, and output the processed signal;

a modulation signal generation unit configured to receive the output signal of the digital signal processor and generate a pulse width modulation signal or a pulse density modulation signal;

a controller configured to receive an external signal or a control signal from the mobile electronic device and control an operation of the first heating aid device and the mobile electronic device;

a first connection device conversion unit connected to the mobile electronic device through the first connection device; and a second connection device conversion unit connected to the second hearing aid device through the second connection device.

2. The hearing aid of claim 1, wherein the microphone array is configured to have m microphones arrayed in the microphone array in a one-dimensional, two-dimensional, or three-dimensional manner, wherein m is a natural number of four or more; and the beamformer unit is configured to delay the output signals by respective predetermined times, and add up the delayed signals to output the beamformer unit output signal that is a digital signal.

3. The hearing aid of claim 1, wherein the mobile electronic device comprises a smart phone, a tablet PC, or a portable multimedia player in which a central processing unit (CPU) and a battery are embedded.

4. The hearing aid of claim 1, further comprising a third hearing aid device configured to have a structure identical with a structure of the second hearing aid device and connected to the first hearing aid device through the second connection device, wherein the second hearing aid device and the third hearing aid device are placed in left and right ears of the user.

5. The hearing aid of claim 1, wherein the first hearing aid device is supplied with power from the mobile electronic device through a conducting wire for power supply included in the first connection device.

6. The hearing aid of claim 5, wherein the first connection device uses a digital data transmission method other than the conducting wire for power supply.

7. The hearing aid of claim 6, wherein:

the first connection device uses interface methods according to a universal serial bus (USB) standard and a mobile high definition link (MHL) standard, and the first connection device uses only one of the interface methods according to the two standards on a specific time.

8. The hearing aid of claim 1, wherein the second connection device comprises an earphone cable or a wireless transmission device.

9. The hearing aid of claim 2, wherein:

the beamformer unit further comprises a storage device configured to comprise information about the delay times of the plurality of output signals of the microphone array, and the storage device is included in a single integrated circuit chip along with the beamformer unit.

10. The hearing aid of claim 9, wherein contents of the storage device are downloaded from the mobile electronic device to the storage device only once through the first connection device when the first hearing aid device is first connected to the mobile electronic device or right after the first hearing aid device is reset.

11. The hearing aid of claim 1, wherein the first hearing aid device operates in a hearing aid mode and a telephone call mode.

12. The hearing aid of claim 11, wherein:

when the first hearing aid device operates in the hearing aid mode, the MUX selects the beamformer unit output signal and transfers the selected beamformer unit output signal to the digital signal processor, when the first hearing aid device operates in the telephone call mode, the MUX selects an audio signal output by the mobile electronic device through the first connection device conversion unit and transfers the selected audio signal to the digital signal processor, and the controller performs control so that the speaker of the mobile electronic device connected to the first hearing aid device is turned off through the first connection device conversion unit.

13. The hearing aid of claim 1, wherein parameter values for an operation of the first hearing aid device are controllable through an application program operating in the mobile electronic device.

14. The hearing aid of claim 2, wherein each of the microphones forming the microphone array outputs a differential analog signal.

15. The hearing aid of claim 2, wherein the beamformer unit comprises:

m channels each configured to comprise a pre-processing amplifier, a variable gain amplifier, a filter, and an analog to digital converter; and a single digital beamformer, wherein m is a natural number of four or more.

16. The hearing aid of claim 15, wherein:

all of the pre-processing amplifiers, the variable gain amplifiers, the filters, and the analog to digital converters are formed to a fully-differential circuit, and the output signals of the analog to digital converters are subjected to the respective predetermined delay times and added up in the digital beamformer and are output as the beamformer unit output signal.

17. The hearing aid of claim 1, wherein the first connection device conversion unit comprises:

a USB transceiver configured to send and receive a USB input signal and a USB output signal;

a HDMI receiver configured to alternately output a video signal and an audio signal;

an audio data extractor configured to extract only an audio signal from outputs of the HDMI receiver and output the sound output data signal; and a USB/MHL switch connected to a micro-USB port of the mobile electronic device through the first connection device.

18. The hearing aid of claim 17, wherein the first connection device is implemented using a USB cable.

19. The hearing aid of claim 1, wherein the second connection device conversion unit comprises:

a loop antenna for near field magnetic induction (NFMI) transmission;

a voltage to current converter configured to receive the output signal of the first hearing aid device and output a change of a magnetic field by driving the loop antenna for NFMI transmission;

a class D amplifier and a low pass filter configured to receive the output signal of the modulation signal generation unit of the first hearing aid device, amplify the received signal into an audible audio signal, and output the audible audio signal; and an audio jack configured to output the output signal of the low pass filter.

20. The hearing aid of claim 1, wherein all circuits forming the first hearing aid device are disposed on a single printed circuit board (PCB).

21. The hearing aid of claim 1, wherein a central point of the first hearing aid device is placed within 30 cm from a center of the mobile electronic device.

22. The hearing aid of claim 2, wherein the microphones of the microphone array are exposed to an outer surface of the casing of the mobile electronic device.

23. The hearing aid of claim 22, wherein a color or pattern of the microphones exposed to the outer surface of the casing of the mobile electronic device are similar to or identical with a color or pattern of an outside of the casing of the mobile electronic device so that the microphones are rarely distinguished from the casing of the mobile electronic device.

24. The hearing aid of claim 22, wherein a thin cloth or film through which a sound passes on the outer surface of the casing of the mobile electronic device is used as a protection device.

25. The hearing aid of claim 1, wherein a second hearing aid device further comprises a driving circuit optionally.

* * * * *